US005559709A

United States Patent [19]

Ohno et al.

[11] Patent Number: 5,559,709

[45] Date of Patent: Sep. 24, 1996

[54] PATTERN MAKING AND PATTERN DRAFTING SYSTEM

[75] Inventors: Junnosuke Ohno, Tokyo; Muneko Kohsaka, Ashiya; Kazunari Noguchi, Tarumi-ku; Hirotoshi Kamiyama, Takarazuka; Kimiko Nishii, Nara, all of Japan

[73] Assignee: Kabushiki Kaisha World, Kobe, Japan

[21] Appl. No.: 362,116

[22] Filed: Dec. 22, 1994

[30] Foreign Application Priority Data

Dec. 27, 1993 [JP] Japan ..... 5-330171

[51] Int. Cl.[6] ..... G06F 17/50; G06F 19/00

[52] U.S. Cl. ..... 364/468.01; 364/192; 364/470.02; 364/468.04; 382/111

[58] Field of Search ..... 364/470, 474.23, 364/191–193, 188, 189, 474.25, 468; 33/11, 17 R, 17 A; 382/111

[56] References Cited

U.S. PATENT DOCUMENTS 4,692,871 9/1987 Kinoshita et al. ..... 364/470
5,163,006 11/1992 Deziel ..... 364/470
5,353,355 10/1994 Takagi et al. ..... 364/470 X
5,473,535 12/1995 Shigeta et al. ..... 364/470 X

FOREIGN PATENT DOCUMENTS 54-161446 12/1979 Japan .

*Primary Examiner*—Joseph Ruggiero
*Attorney, Agent, or Firm*—Marshall, O'Toole, Gerstein, Murray & Borun

[57] ABSTRACT

A pattern making and pattern drafting system is disclosed. The system has a pattern group, stored in memory, consisting of a plurality of patterns having prescribed base lines and base points. Commands are executed to perform prescribed processing on a reference pattern and are stored into memory, the thus stored commands then being reproduced sequentially on at least one object pattern other than the reference pattern. In reproducing a command, the target point to be processed and the amount of processing to be performed by the command are recognized by reference to existing line consisting of base lines and other lines drawn on the reference pattern and existing points consisting of base points, both end points of each existing line, and other points drawn on the reference pattern.

17 Claims, 18 Drawing Sheets

PATTERN MAKING AND PATTERN DRAFTING SYSTEM

FIELD OF THE INVENTION

The present invention relates to a pattern making and pattern drafting system used in the field of garment making, etc., and more particularly to a pattern making and pattern drafting system wherein a pattern making and pattern drafting process performed on a particular pattern according to a prescribed design is prestored in memory and the prestored contents are adapted to the making of other patterns, thus enabling patterns to be made using base patterns created for various body types and sizes without impairing the impression of the original design.

BACKGROUND OF THE INVENTION

In garment making, first a pattern is cut to actually form a garment from the design created by the designer. Usually, such patterns are made by hand or by using an apparel CAD; the pattern making and the pattern drafting process is called pattern making and pattern drafting. (In this specification, the term "pattern" is used to refer to a broad concept, including patterns displayed on the screen of a CAD machine from which paper patterns are cut.)

Whether the finished garment is comfortable to wear and whether the image intended by the designer is reflected properly in the garment depend on how accurate the pattern is made. The quality of the pattern in turn depends on the skill of individuals, whether an apparel CAD is used or not, and under the current circumstances, it largely depends on the workmanship of skilled patternmakers.

On the other hand, with the recent trend toward diversification and individuality of dress fashion design, apparel makers are urged to supply garments in a variety of designs and for different types of body shapes and sizes. Under these circumstances, apparel makers are being pressed with increasing amount of pattern making and pattern drafting work, and hence, the need to further reduce the time required for pattern making and pattern drafting. It is therefore imperative to reduce the dependence of pattern making and pattern drafting on skilled workers only.

Various approaches have been made to solve such a problem, and one such approach, which aims at reducing the time and labor required for pattern making and pattern drafting by improving apparel CAD, is disclosed in Japanese Laid-open Patent Publication No. 54-161446. In the apparel CAD described in this Publication, processing instructions for pattern making and pattern drafting are supplied, using an instruction sheet, to a system in which a plurality of base patterns and pattern making and pattern drafting theories are prestored. Using this apparel CAD, the time and labor required for pattern making and pattern drafting can be reduced to a certain extent.

However, with the apparel CAD disclosed in the above Publication, since processing instructions for pattern making and pattern drafting have to be entered using an instruction sheet, the apparel CAD is not easy for the operator to use. For example, to add gathers, the above prior art apparel CAD requires that the distance, etc., from the center of the gather stop position be entered as numeric values into the instruction sheet. In an actual pattern making and pattern drafting process, however, skilled patternmakers recognize the distance from the center of the gather stop position by intuition, not as numeric values. If such items which are normally grasped intuitively are entered as numeric values in the instruction sheet for CAD processing, the final result will be different from what was perceived intuitively. Furthermore, since the process of preparing such an instruction sheet is different in nature from the process of operating a conventional apparel CAD, the work is cumbersome for those well skilled in CAD operations.

Furthermore, in the apparel CAD described in the above Patent Publication, the above numeric values are only given in actual dimensions, i.e., as absolute coordinates; therefore, the processing contents of the instruction sheet cannot be applied directly to the making of other patterns in a different size, and such processing as multiplication by a predetermined ratio becomes necessary. Moreover, when the processing contents of the instruction sheet are applied to the making of other patterns for a different body type, a proper pattern cannot be obtained even if the multiplication by a predetermined ratio, as described above, is performed. In such a case, the finished garment will not be comfortable to wear, nor will the design image intended by the designer be reflected into the garment.

The present invention has been devised to overcome the above problems associated with the prior art, and it is an object of the invention to provide a pattern making and pattern drafting system capable of making patterns based on the pattern making and pattern drafting process actually performed on a reference pattern (one of the original base patterns made by skilled patternmakers). It is another object of the invention to provide a pattern making and pattern drafting system capable of reproducing the comfortable cut and design image of the reference pattern in other body types' patterns even when the pattern making and pattern drafting process for the reference pattern is repeated for the making of other patterns for different body types.

SUMMARY OF THE INVENTION

To achieve the above objects, the pattern making and pattern drafting system of the present invention comprises: (A) pattern storing means for storing a pattern group consisting of a plurality of patterns each having a prescribed base line and base point; (B) command executing means for executing commands to perform prescribed processing on said patterns; (C) executed-command storing means for sequentially storing the commands performed by an operator on a reference pattern selected from said pattern group; and (D) command reproducing means for sequentially reproducing the commands stored in said executed-command storing means, thereby performing the processing, in the same sequence as followed by said command executing means, on at least one object pattern to be processed, other than said reference pattern, selected from said pattern group.

Preferably, said executed-command storing means stores executed-command information including information selected from the type of command executed by said command executing means, a target line for processing, a target point for processing, and the amount of processing performed, said target point and said amount of processing being recognized by reference to existing lines consisting of said base line and other lines drawn on said reference pattern and existing points consisting of said base point, both end points of each of said existing lines, and other points drawn on said reference pattern.

Preferably, in the above configuration, said executed-command storing means further includes on-the-line point recognizing means for recognizing said target point lying on any one of said existing lines as an on-the-line point, wherein said on-the-line point recognizing means recognizes said on-the-line point by reference to: said existing line on which said point lies; a ratio L/A where A is the overall length from one end to the other end of said existing line and L is the length measured from said one end to said on-the-line point; and said one end of said existing line.

In a further preferred mode, said executed-command storing means further includes free point recognizing means for recognizing said target point not lying on any of said existing lines as a free point, wherein said free point recognizing means obtains coefficients $\alpha$ and $\beta$ from the equation:

$$\text{Position of free point}=\alpha x\ (\text{vector } PQ)+\beta x\ (\text{vector } PR);$$

where P is a nearest existing point selected from among said existing points as being the nearest to said free point and PQ and PR are vectors leading from said nearest existing point P to two existing points Q and R adjacent thereto, and recognizes said free point by said vectors PQ and PR and said coefficients $\alpha$ and $\beta$.

Preferably, said executed-command storing means further includes a curve recognizing means for recognizing the shape and position of a curve defined by a start point, an end point, and at least one intermediate point, wherein said curve recognizing means recognizes the shape and position of a curve by reference to: said start point and said end point; the ratio, to the length of a reference straight line connecting said start point and said end point, of the distance from said intermediate point to an intersection where a straight line passing through said intermediate point intersects at right angles with said reference straight line; and the ratio of the distance from said start point to said intersection, to the length of said reference straight line.

In a preferred mode of the invention, the pattern making and pattern drafting system further comprises processing amount ratio storing means for storing the ratio between the amount of processing included in said executed-command information for said reference pattern and the amount of processing included in said executed-command information for said object pattern, for a command for obtaining said amount of processing from said executed-command information, wherein when reproducing a command, executed on said reference pattern and stored in said executed-command storing means, on said object pattern, said command reproducing means obtains the amount of processing to be performed by said command on said object pattern by reference to said ratio stored in said processing amount ratio storing means.

In a further preferred mode of the invention, the pattern making and pattern drafting system further comprises dart dividing means for dividing a dart into multiple darts, tapering off to a dart base point inside a pattern from two dart end points lying on an existing line forming a periphery of said pattern, by using two manipulating lines extending substantially parallel to said dart from manipulating base points respectively lying outward of said dart end points on the base line forming said periphery, wherein said dart dividing means obtains a point of intersection between each of said manipulating lines or an extended line thereof and a perpendicular dropped to said manipulating line or said extended line, obtains two cut parts by cutting along lines respectively extending from said points of intersection to said manipulating base points and along lines respectively extending from said points of intersection to said dart base point, finds an angle of rotation, $\gamma_0$, of one cut part and an angle of rotation, $\delta_0$, of the other cut part when said cut parts are rotated, describing arcs with line segments connecting said points of intersection to said dart end points as respective radii, in such a manner as to bring said dart end points into registry at an intersection of said arcs, and rotates said cut parts about said respective points of intersection toward the intersection between said arcs to determine the positions of said cut parts at prescribed positions where the ratio of an angle of rotation, $\gamma$, of said one cut part to an angle of rotation, $\delta$, of said other cut part, i.e., the ratio $\gamma/\delta$, becomes equal to the ratio $\gamma_0/\delta_0$.

Preferably, in the above configuration, said executed-command storing means performs recognition in terms of a ratio W'/W, i.e., the ratio of the distance W' between said dart end points after dart dividing to the distance W between said dart end points before dart dividing.

Preferably, said pattern group consists of patterns in a plurality of sizes for one body type or for each of a plurality of body types.

According to the pattern making and pattern drafting system of the present invention, when an operator performs pattern making and pattern drafting on a reference base pattern for the production of patterns, the commands performed on the reference base pattern are sequentially stored in memory, and then, the executed commands thus stored are reproduced on an object pattern in the same sequence as performed on the reference base pattern, thus producing patterns for the target pattern. The executed commands thus stored are carried out on one or a plurality of object patterns.

In the pattern making and pattern drafting system of the present invention, each base pattern comprises base lines consisting of a plurality of peripheral lines and pattern making lines drawn inside them, and base points consisting of end points of each of these base lines and other points (for example, an independent point indicating a bust point).

The pattern storing means, command executing means, executed-command storing means, and command reproducing means in the present invention are implemented inside an apparel CAD constructed using a computer. With this configuration, pattern making and pattern drafting operations actually performed by a skilled patternmaker on a reference base pattern can be performed on other base patterns, so that patterns can be made with ease and in a short period of time from one or a plurality of patterns stored in the pattern group.

In the pattern making and pattern drafting system of the present invention, executed commands are stored as executed-command information. The executed-command information includes necessary information selected from the type of command executed, a target line for processing, a target point for processing, and the amount of processing performed. The commands used in the system of the present invention are shown in Table 1. The commands shown in Table 1 are only illustrative, and commands having any other function than those listed here can be used in the system of the present invention. Furthermore, a new command created by combining any of these commands can also be used in the system of the present invention.

TABLE 1

| Menu | Submenu | Command Type | Target line/point | Amount of processing | Reference to processing amount ratio |
|---|---|---|---|---|---|
| Lines | Construction of lines | Straight line | Start point, End point | Distance | Δ |
| | | Cure | Start point, intermediate points, end point | Distance | Δ |
| | | Perpendicular | Passing point, Line on which to drop a perpendicular, End points of perpendicular | | |
| | | Parallel line | Original line, Passing point | Parallel line spacing | o |
| | | Tangent | Passing point, Line on which to draw a tangent, End point other than contact point on tangent | | |
| | | Extension of line | Line to be extended, End point from which to extend the line, Point indicating the extended distance | | |
| | | Redrawing of line | On-the-line point 1, On-the-line point 2 | | |
| | | Correction of line | On-the line point (pick point), On-the-line points (two fixed points) | | |
| | | Abutting line correction | Lines to connect, Lines to abut | | |
| Marking | | Free | Desired point | | |
| | | XY | Origin, X value, Y value | Distance | Δ |
| | | On-the-line | Line on which to form a point, Base point | Distance | Δ |
| | | Bisecting point | Two end points | | |
| Parts | | Parallel displacement | Target part | Amount of displacement | o |
| | Alignment | Point alignment | Target parts (two Parts), Base point, Point to be aligned with base point | | |
| | | Line alignment | Target parts (two parts), Reference line, Line to be aligned with reference line | | |
| | Copy | Whole copy | Target part | | |
| | | Partial copy | Target lines | | |
| | | Parts cut | Cut lines | | |
| | Rotation | Whole | Target part, Base point of rotation | Angle of rotation | o |
| | Parts Composition | Line designation | Target parts (two parts), Reference line, Line to be aligned with reference line | | |
| | | Arrangement | Target parts | | |
| | | Release | Target parts | | |
| Special functions | | Successive manipulating | Target parts, connection point, base point | Angle of rotation | o |
| | Dart processing | Dividing | Dart line, Development lines (two lines) | Angle, Width | o |
| | | Pivoting | Dart line, Development line | Angle, Width | o |
| | | Change of length | Dart line | Amount of displacement | o |
| Erasure | | Point | Target point | | |
| | | Line | Target line | | |
| | | Part | Target part | | |
| Tool box | | Mirror | Symmetrical base lines, Target lines | | |
| | | Flip | Target part | | |

In Table 1, the term "target part" refers to a set of base lines, base points, etc. which is treated as a single group; basically, these parts can be treated as lines and points.

In the system of the present invention, target points on which commands are performed include four kinds of points: the base point, the on-the-line point, the free point, and the independent point. Of these target points, the base point is a component part forming a base pattern, as previously described, and can be recognized directly by using its coordinates. The on-the-line point is a point lying on an existing line, where the term "existing line" refers generally to the base line and other lines drawn on the pattern by using a command. The free point refers to a point that does not lie on an existing line, but is recognized by using two vectors, as will be described later. The independent point is a target point that does not fall in any category of base point, on-the-line point, or free point. In this specification, the base point and any other point created as an on-the-line point, a free point, or an independent point by using a command are generally referred to as existing points.

The on-the-line point is recognized using the procedure shown in FIG. 1. In FIG. 1, an on-the-line point B lies on an existing line S. First, an overall length A from one end M to the other end N of the existing line S is obtained. Next, a length L from the end M to the on-the-line point B of the existing line S is obtained. Then, the ratio L/A is calculated, and the on-the-line point B is recognized by reference to the existing line S on which the on-the-line point B lies, the one end M from which the length L to the on-the-line point B is measured, and the above-obtained ratio L/A. Such on-the-line point recognition is performed by using on-the-line point recognizing means which is implemented inside an apparel CAD constructed using a computer.

The free point is recognized as shown in FIG. 2. The pattern shown in FIG. 2 has existing lines (base lines) $K_1$ $-K_6$. First, a nearest existing point (base point) P, which is nearest to a free point X, is selected from among existing points, and then, two vectors PQ and PR directed to two existing points Q (base point) and R (base point) neighboring to the nearest existing point P are obtained. Next, using these two vectors PQ and PR, coefficients α and β are uniquely obtained from the equation:

$$\text{Position of free point } X=\alpha x \text{ (vector } PQ)+\beta x \text{ (vector } PR).$$

The free point X can be recognized by reference to the coefficients $\alpha$ and $\beta$ and the vectors PQ and PR. Such free point recognition is performed by using free point recognizing means which is implemented inside an apparel CAD constructed using a computer.

By recognizing the on-the-line point and free point in the above manner, the same comfortable cut and design image of a garment as obtained from the reference base pattern can be obtained when the pattern making and pattern drafting process performed on the reference base pattern is applied to the making of other base patterns.

When the pattern making and pattern drafting process performed on a reference pattern is stored in memory and the same pattern making and pattern drafting process is reproduced on an object pattern to be processed, if a curve opening downwardly, for example, is recognized using the above-described on-the-line point or free point, the curvature may be changed greatly, and in an extreme case, the curve may turn into an upwardly opening curve. Such deformation in curvature results in substantial impairment of the design image.

To prevent such curvature deformation, the pattern making and pattern drafting system of the present invention is provided with curve recognizing means for recognizing the shape and position of a curve. This curve recognizing means is implemented inside an apparel CAD constructed using a computer. The shape and position of a curve are recognized as shown in FIG. 3. It is assumed, in FIG. 3, that the curve to be recognized is defined by a start point S, an end point T, and two intermediate points $U_1$, $U_2$.

First, a reference straight line ST connecting the start point S and end point T of the curve $SU_1U_2T$ is drawn. Next, perpendiculars $t_1$ and $t_2$ respectively passing through the intermediate points $U_1$ and $U_2$ of the curve $SU_1U_2T$ and intersecting at right angles with the reference straight line ST are drawn. Furthermore, intersections $T_1$ and $T_2$ where the respective perpendiculars $t_1$ and $t_2$ intersect the reference straight line ST are obtained. Then, vectors $T_1U_1$ and $T_2U_2$ directed from the intersections $T_1$ and $T_2$ to the intermediate points $U_1$ and $U_2$, respectively, are obtained.

The shape and position of the curve $SU_1U_2T$ are recognized by reference to: the start point S and end point T of the curve $SU_1U_2T$; the ratios, ($ST_1$/ST) and ($ST_2$/ST), of the lengths, $ST_1$ and $ST_2$, from the start point S to the respective intersections $T_1$ and $T_2$, to the length ST from the start point S to the end point T; and the ratios, ($T_1U_1$/ST) and ($T_2U_2$/ST), of the distances from the intersections $T_1$ and $T_2$ to the respective intermediate points $U_1$ and $U_2$, to the length ST. Here, the distances from the intersections $T_1$ and $T_2$ to the respective intermediate points $U_1$ and $U_2$ are positive when measured in one direction from the reference curve ST as shown in FIG. 3, and are negative when measured in the direction opposite to that shown in FIG. 3, with the points on the reference curve ST being taken as 0. The curve recognizing means can be used when, for example, performing the Curve command and Correction of line command shown in Table 1. With the above configuration, curvature deformation is prevented, and the garment design image obtained from the reference pattern can be reflected without loss in the garment obtained from the object pattern.

For some of the commands used in the system of the present invention, the amount of processing performed is stored as executed-command information. Examples of such amounts of processing include those shown in the column of "Amount of processing" in Table 1. These amounts of processing can be grasped as numeric values in an absolute coordinate system. When such commands are carried out on an object pattern to be processed different from the reference pattern, the finished garment may be different in cut and design image from that obtained from the reference pattern.

To overcome this disadvantage, the system of the present invention is provided with processing amount ratio storing means for storing the ratio between the amount of processing included in the executed-command information for the reference pattern and the amount of processing included in the executed-command information for the object pattern, for a command whose amount of processing is obtained from the reference pattern. This processing amount ratio storing means is implemented inside an apparel CAD constructed using a computer. When a command executed on the reference pattern is to be carried out on the object pattern, the processing amount ratio is referenced to determine the amount of processing to be performed on the object pattern. Examples of the commands that use such processing amount ratio include those marked o or $\Delta$ in the column of "Processing amount ratio needed/not needed" in Table 1. Of these commands, those marked o are commands usually carried out by referencing the processing amount ratio, and those marked $\Delta$ are commands that are usually carried out without referencing the processing amount ratio but carried out by referencing it when needed.

In the system of the present invention, the pattern group may consist of patterns in a plurality of sizes for one body type, or may consist of patterns in a plurality of sizes for each of a plurality of body types. Furthermore, the system of the invention can be applied to custom-made garments for which patterns are made from the base pattern cut for each individual wearer.

The term "body type" used in this specification refers to designations such as "Type A, Type Y, and Type B" provided by JIS L4005, commonly used classifications such as Junior Type, Miss Type, Tall Miss Type, Missy Type, Women Type in U.S. market, etc., and makers' own classifications. The term also refers to a broad concept including brands that individual makers create for different body types. The term "size" refers to the size designated by "grade", for example, each body type being graded into many different sizes.

Furthermore, in the pattern making and pattern drafting system of the present invention, guidelines unique to the pattern group, as well as the commonly used reference lines forming each pattern, can be used as the base lines. Also, in addition to the end points of each base line, other reference points can be added as base points. What guidelines and reference points should be added depends on the application of the pattern group, for example, whether it is for a skirt or for a vest, and much depends on the experience of the patternmaker. There is no general rule. However, it will be recognized that by adding an appropriate number of appropriate guidelines and reference points, the comfortable cut and design image of the garment obtained from the reference pattern can be accurately reproduced in the garment obtained from the object pattern.

In the pattern making and pattern drafting system of the present invention, the pattern making and pattern drafting processing steps actually performed by the operator on a reference pattern are sequentially stored into memory, and the pattern making and pattern drafting processing steps stored into memory are reproduced on an object pattern. Therefore, once the pattern making and pattern drafting processing is performed for the reference pattern, the pattern making and pattern drafting processing for other patterns can be performed automatically.

According to the pattern making and pattern drafting system of the invention, the target point and the amount of processing performed by each command are recognized with respect to existing lines and points. More specifically, an on-the-line point is recognized in terms of the ratio of the distance from an end point of the line to the entire length of the line, a free point is recognized using two vectors, or the position and shape of a curve are recognized in terms of the ratio of an intermediate point to the length of the curve between its end points. Furthermore, the ratio of the amount of processing performed by a command on the object pattern to the amount of processing performed by a command on the reference pattern is predetermined as the processing amount ratio. With this construction, the comfortable cut and design image of the garment produced from the reference pattern can be directly reflected in the garment produced from the object pattern.

Furthermore, by forming a pattern group consisting of patterns in a plurality of sizes for one body type, patterns for the same body type can be made in different sizes without impairing the cut and design image of the garment intended by the reference patterns. Moreovers by forming a pattern group consisting of patterns in a plurality of sizes for each of a plurality of body types, patterns for different body types can be made in different sizes without impairing the cut and design image of the garment intended by the reference patterns.

BRIEF DESCRIPTION OF THE DRAWINGS

FIGS. 4(*c*) and 4(*d*) show patterns (object patterns) for a front skirt and a back skirt, respectively, for Missy Body Type before pattern making and pattern drafting processing.

DETAILED DESCRIPTION OF PREFERRED EMBODIMENTS

Figure 19:
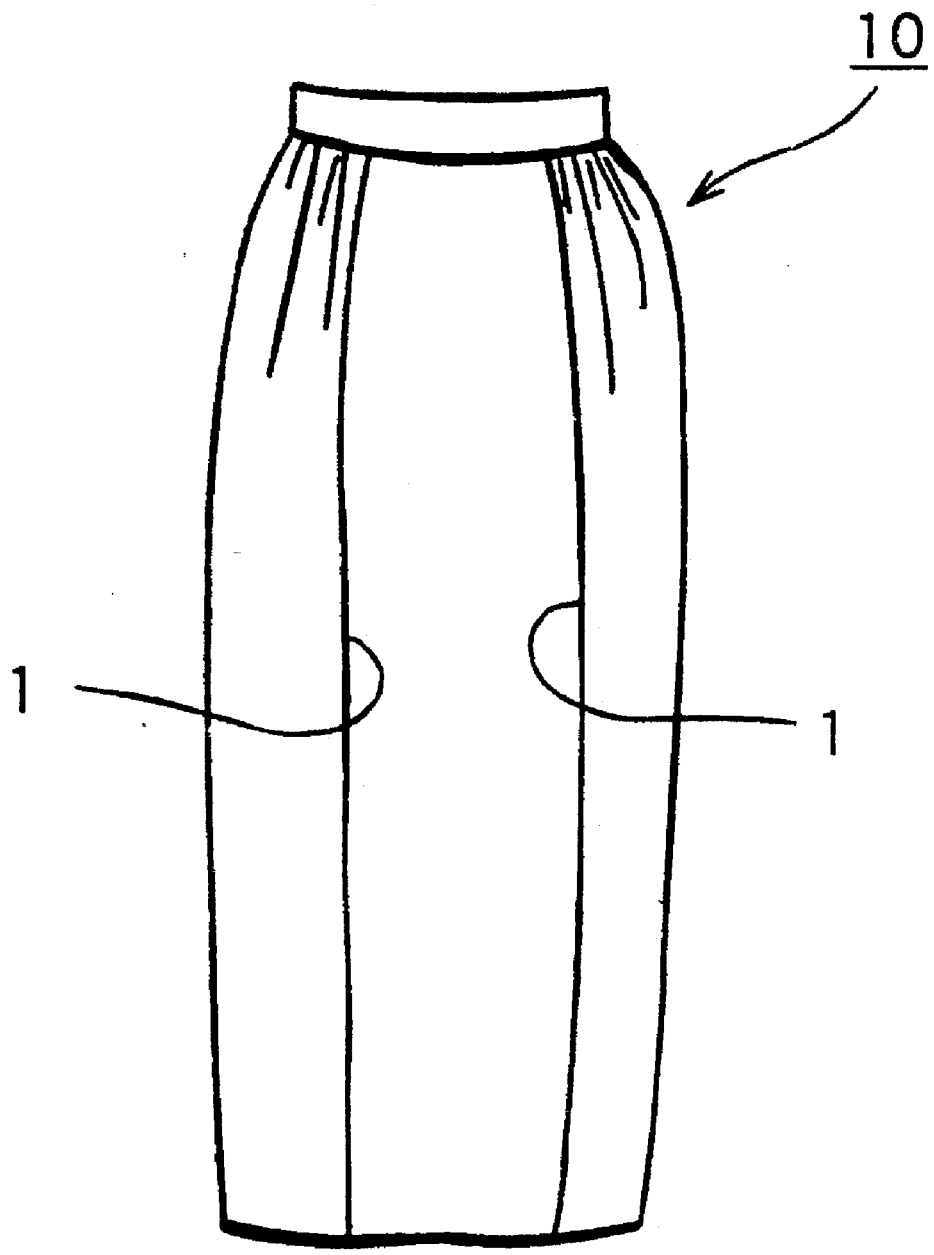
FIG. 19 is a diagram illustrating an example of a skirt made by using the patterns produced by the pattern making and pattern drafting system of the present invention.
Figure 20A:
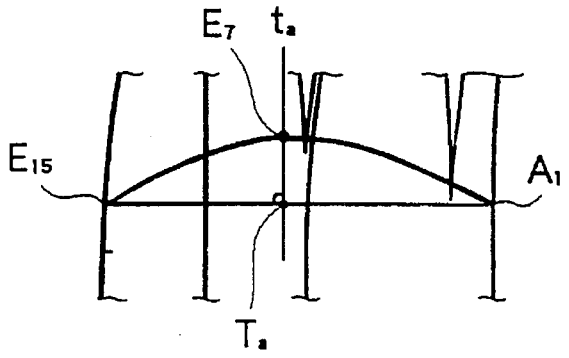
FIGS. 20(*a*) to 20(*d*) are diagrams for showing how gathering end points mark lines are recognized.
Figure 20B:
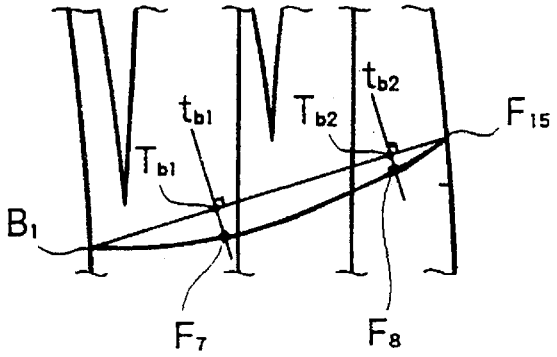
Figure 20C:
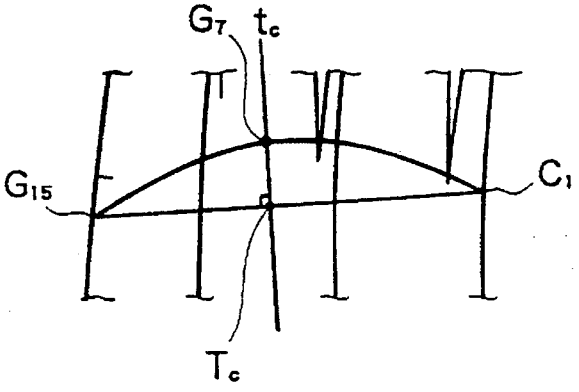
Figure 20D:
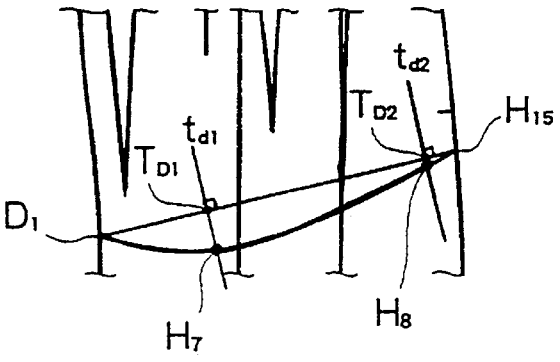
Figure 21:
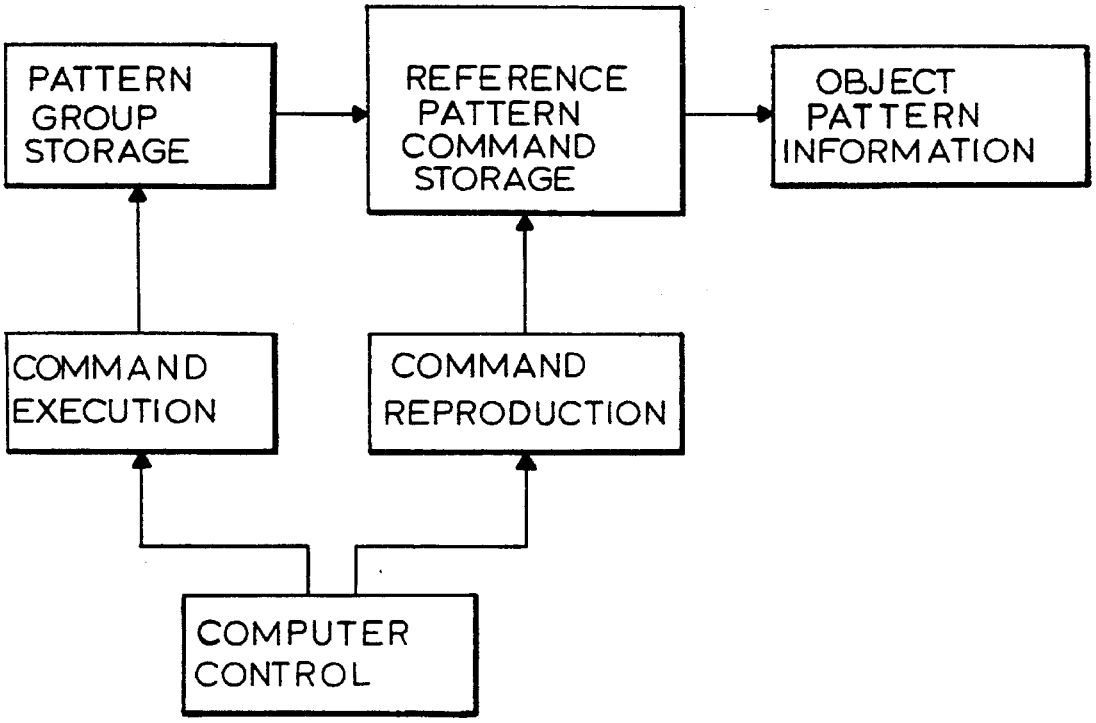
FIG. 21 is a schematic block diagram showing the system of the present invention.

One embodiment of pattern making and pattern drafting system according to the present invention will be described in detail below with reference to the accompanying drawings. In this embodiment, the skirt 10 shown in FIG. 19 is taken as an example, and explanation will be given as to how the commands executed on a base pattern for a skirt pattern for Women Body Type are reproduced for the production of a skirt pattern for Missy Body Type. FIGS. 4 to 20 show how the pattern making and pattern drafting processing is performed to produce the reference patterns and object patterns by the commands executed or reproduced by the pattern making and pattern drafting system of the invention. Some of FIGS. 4 to 20 consist of four diagrams (a) to (*d*), wherein diagram (a) shows the pattern (reference pattern) for a front skirt for Women Body Type, and diagram (*b*) shows the pattern (reference pattern) for a back skirt for Women Body Type, while diagram (*c*) shows the pattern (object pattern) for a front skirt for Missy Body Type, and diagram (*d*) shows the pattern (object pattern) for a back skirt for Missy Body Type. FIG. 21 illustrates a computer controlled system for implementing the present invention.

For convenience of explanation, the commands executed on the reference patterns and the commands reproduced on the object patterns will be described below side by side, but in an actual system, the commands for the object patterns are reproduced after all the commands have been performed on the reference patterns.

In the patterns shown in FIGS. 4(*a*) to 4(*d*), $a_{G1}$, $a_{G2}$, $b_{G1}$, $b_{G2}$, $C_{G1}$, $C_{G2}$, $d_{G1}$, and $d_{G2}$ are guidelines uniquely determined for Women Body Type and Missy Body Type in this embodiment, respectively, and the other lines are reference lines forming the patterns used in ordinary pattern making and pattern drafting.

First, a panel line "a" for the front skirt and a panel line "b" for the back skirt are drawn, as shown in FIGS. 5(*a*) and 5(*b*) , on the reference patterns shown in FIGS. 4(*a*) and 4(*b*) , respectively. The commands executed at this time are reproduced on the object patterns shown in FIGS. 4(*c*) and 4(*d*). As a result, a panel line "c" for the front skirt and a panel line "d" for the back skirt are obtained as shown in FIGS. 5(*c*) and 5(*d*). The panel line "a" consists of two straight lines, $A_1A_2$ and $A_1A_3$, and the panel line "b"

consists of two straight lines, $B_1B_2$ and $B_1B_3$. Of these straight lines, the straight lines $A_1A_2$ and $B_1B_2$ are drawn by using the straight line command shown in Table 1, with two points $A_1$ and $A_2$ designated for the former and two points B1 and B2 for the latter. Point $A_2$ is recognized as a point on curve $E_1E_2$, and is defined by the length of curve $E_1E_2$, i.e. 73.4, the length of curve $A_2E_2$, i.e. 8.9, and the ratio between the two, i.e. 0.12 (8.9/73.4), as shown in Table 2. Similarly, point $B_2$ is recognized as a point on curve $F_1F_2$, and is defined by the length of curve $F_1F_2$, i.e. 73.3, the length of curve $B_2F_2$, i.e. 9.9, and the ratio between the two, i.e. 0.14 (9.9/73.3), as shown in Table 2.

Next, the point $A_1$ is recognized as a free point, which is determined as follows. First, a nearest existing point $E_5$, which is nearest to the point $A_1$, is obtained, and then, two existing points, $E_2$ and $E_6$, neighboring to the point $E_5$ are obtained. Then, two vectors $E_5E_2$ and $E_5E_6$ are obtained. The components of these two vectors are shown in Table 3. Using these two vectors, the following equation is solved:

$$\text{Position of point } A_1=\alpha x \text{ (vector } E_5E_2)+\beta x \text{ (vector } E_5E_6)\,.$$

From this equation, coefficient $\alpha$=0.723 and coefficient $\beta$=−0.769 are uniquely determined. The point $A_1$ is recognized by the vectors $E_5E_2$ and $E_5E_6$ and the coefficients $\alpha$ and $\beta$. In a similar way, the coefficients $\alpha$ and $\beta$ are determined for point $B_1$, which is likewise recognized as a free point.

The straight line $A_1A_3$ and straight line $B_1B_3$ are each drawn by using a perpendicular command; the former is drawn perpendicular to the straight line $E_3E_4$ by designating the point $A_1$ and straight line $E_3E_4$, and the latter perpendicular to the straight line $F_3F_4$ by designating the point $B_1$ and straight line $F_3F_4$. The point $A_1$ and point $B_1$ are respectively recognized as free points, and point $A_3$ is obtained as a result of the execution of the perpendicular command; therefore, the point $A_3$ is recognized by the point $A_1$ and straight line $E_3E_4$, and similarly, point $B_3$ is recognized by the point $B_1$ and straight line $F_3$ $F_4$.

Next, the above straight line command and perpendicular command are reproduced on FIGS. 4(*c*) and 4(*d*) to obtain the panel lines "c" and "d" shown in FIGS. 5(*c*) and 5(*d*), respectively.

At this time, point $C_2$ and point $D_2$ are obtained by using the respective ratios shown in Table 2. That is, for the front skirt, the ratio, 0.12, of curve $A_2E_2$ to curve $E_1E_2$ is multiplied by the length, 79.3, of curve $G_1G_2$, to obtain the length of curve $C_2G_2$, thus determining the position of point $C_2$. In a similar way, the position of point $D_2$ is determined for the back skirt.

TABLE 2

Recognition of on-the-line points Recognition of points $C_2$ and $D_2$

| | Women Body Type | | Missy Body Type | |
|---|---|---|---|---|
| Back skirt | $F_1F_2$ | 73.3 | $H_1H_2$ | 81.4 |
| | $B_2F_2$ | 9.9 | $D_2H_2$ | 11.0 |
| | Ratio | 0.14 | Ratio | — |
| Front skirt | $E_1E_2$ | 73.4 | $G_1G_2$ | 79.3 |
| | $A_2E_2$ | 8.9 | $C_2G_2$ | 9.6 |
| | Ratio | 0.12 | Ratio | — |

Next, point $C_1$ is obtained in the following manner. First, vectors $G_5G_2$ and $G_5G_6$ corresponding to the two vectors $E_5E_2$ and $E_5E_6$ are obtained. The components of the thus obtained two vectors are shown in Table 3. Using these two vectors and the first obtained coefficients $\alpha$ and $\beta$, the following equation is solved to obtain the point $C_1$:

$$\text{Position of point } C_1=\alpha x \text{ (vector } G_5G_2)+\beta x \text{ (vector } G_5G_6).$$

The position of point $D_1$ can be obtained in a similar manner.

TABLE 3

Recognition of free points Recognition of points $C_1$ and $D_1$

| | Women Body Type | | | Missy Body Type | | |
|---|---|---|---|---|---|---|
| Back skirt | $F_5$ | 0.0 | 0.0 | $H_5$ | 0.0 | 0.0 |
| | $F_2$ | −18.7 | 132.9 | $H_2$ | −12.8 | 125.8 |
| | $F_6$ | 11.7 | 133.5 | $H_6$ | 8.8 | 126.0 |
| | $B_1$ | −13.5 | −24.4 | $D_1$ | −9.7 | −22.9 |
| Coefficient | | $\alpha$ = 0.374 | | | $\beta$ = −0.556 | |
| Front skirt | $E_5$ | 0.0 | 0.0 | $G_5$ | 0.0 | 0.0 |
| | $E_2$ | 16.8 | 112.1 | $G_2$ | 17.0 | 102.4 |
| | $E_6$ | −7.1 | 113.0 | $G_6$ | −3.5 | 103.9 |
| | $A_1$ | 17.6 | −5.9 | $C_1$ | 15.0 | −5.9 |
| Coefficient | | $\alpha$ = 0.723 | | | $\beta$ = −0.769 | |

When the positions of the points $C_1$ and $D_1$ are determined, the command for drawing a perpendicular is reproduced to draw perpendicular lines from these points to straight lines $G_3G_4$ and $H_3H_4$, and thus, points $C_3$ and $D_3$ are obtained.

Next, lines 2*a*, 2*b*, 2*c*, and 2*d*, at which to stop the flow of gatherings, are drawn as shown in FIGS. 6(*a*) to 6(*d*) (these lines are hereinafter called the gathering end points mark lines). The gathering end points mark lines 2*a* and 2*b* are drawn by using a curve command. The gathering end points mark line 2*a* is recognized by its end points $A_1$, $E_{15}$ and intermediate point $E_7$, while the gathering end points mark line 2*b* is recognized by its end points $B_1$, $F_{15}$ and intermediate points $F_7$, $F_8$. Of these points, the points $A_1$ and $B_1$ are respectively recognized as on-the-line points (end points) lying on the straight lines $A_1A_2$ and $B_1B_2$, respectively. The points $E_{15}$ and $F_{15}$ are respectively recognized as points on curves $E_8E_{16}$ and $F_{10}F_{16}$; the coordinates and ratios of these points are shown in Table 4. From the values shown in Table 4, the points $G_{15}$ and $H_{15}$ shown in FIGS. 6(*c*) and 6(*d*) are obtained following a similar procedure to that described above.

TABLE 4

Recognition of on-the-line points Recognition of points $G_{15}$ and $H_{15}$

| | Women Body Type | | Missy Body Type | |
|---|---|---|---|---|
| Back skirt | $F_{10}F_{16}$ | 188.9 | $H_{10}H_{16}$ | 186.3 |
| | $F_{10}F_{15}$ | 64.9 | $H_{10}H_{15}$ | 64.0 |
| | Ratio | 0.344 | Ratio | — |
| Front skirt | $E_8E_{16}$ | 188.9 | $G_8G_{16}$ | 186.3 |
| | $E_8E_{15}$ | 65.0 | $C_8G_{15}$ | 64.1 |
| | Ratio | 0.344 | Ratio | — |

The position and shape of the gathering end points mark line 2*a* are recognized as shown in FIG. 20(*a*). First, a reference straight line $A_1E_{15}$ connecting the end points $A_1$ and $E_{15}$ is drawn, and then, a perpendicular line $t_a$ passing through the intermediate point $E_7$ and perpendicular to the reference straight line $A_1E_{15}$ is drawn. Further, an intersection $T_a$ between the perpendicular line $t_a$ and reference straight line $A_1E_{15}$ is obtained. Then, a vector $T_aE_7$ directed from the intersection $T_a$ to the intermediate point $E_7$ is obtained. The position and shape of the gathering end points mark line 2*a* are recognized by its end points $A_1$, $E_{15}$, the ratio ($A_1T_a/A_1E_{15}$) of the distance from end point $A_1$ to intersection $T_a$ to the length of the reference straight line $A_1E_{15}$, and the ratio ($T_aE_7/A_1E_{15}$) of the distance from intersection $T_a$ to intermediate point $E_7$ to the length of the reference straight line $A_1E_{15}$. Here, the distance from the intersection $T_a$ to the intermediate point $E_7$ is expressed in positive value when measured from the reference curve $A_1E_{15}$ toward the upper part of the skirt, and in negative value when measured toward the lower part of the skirt, with the point on the reference curve $A_1E_{15}$ being taken as 0. Values relating to the above processing are shown in specific form in Table 5.

TABLE 5

Recognition of gathering end points mark line $2_c$ for front skirt

| Women Body Type | | Missy Body Type | |
|---|---|---|---|
| Length $A_1E_{15}$ | 168.3 | Length $C_1G_{15}$ | 167.7 |
| Length $A_1T_a$ | 91.3 | Length $C_1T_c$ | 90.9 |
| Ratio $(A_1T_a/A_1E_{15})$ | 0.542 | Ratio $(C_1T_c/C_1G_{15})$ | — |
| Distance $T_aE_7$ | +28.1 | Distance $T_cG_7$ | +28.0 |
| Ratio $(T_aE_7/A_1E_{15})$ | 0.167 | Ratio $(T_cG_7/C_1G_{15})$ | — |

The thus recognized gathering end points mark line 2*a* for Women Body Type is reproduced on the pattern for Missy Body Type, as shown in FIG. 20(*c*), by using the ratios shown in Table 5. First, the points on the gathering end points mark line 2*c* corresponding to the end points $A_1$ and $E_{15}$ of the gathering end points mark line 2*a* are identified as being points $C_1$ and $G_{15}$, respectively. Then, the length of a reference straight line $C_1G_{15}$ bounded by these points is obtained. The length $C_1G_{15}$ is multiplied by the first obtained ratio $(A_1T_a/A_1E_{15})$, to obtain the length $C_1T_c$, thus determining the position of intersection $T_c$. Next, a perpendicular line $t_c$ perpendicular to the reference straight line $C_1G_{15}$ at the intersection $T_c$ is drawn. The length $C_1G_{15}$ is then multiplied by the ratio $(T_aE_7/A_1E_{15})$, to obtain the distance $T_cG_7$, and the point on the perpendicular line $t_c$ spaced apart from the intersection $T_c$ by the distance $T_cG_7$ is determined as the position of an intermediate point $G_7$. The gathering end points mark line 2*c* is then determined using the end points $C_1$, $G_{15}$ and intermediate point $G_7$.

The recognition of the gathering end points mark line 2*b* and the reproduction of the gathering end points mark line 2*d* for the back skirt are performed in the same manner as described above, except that the gathering end points mark line 2*b* is recognized by its end points $B_1$, $F_{15}$ and two intermediate points $F_7$, $F_8$, as previously described. More specifically, as shown in FIG. 20 (*b*), for the gathering end points mark line 2*b*, two perpendicular lines $t_{b1}$, $t_{b2}$ and two intersections $T_{b1}$, $T_{b2}$ are obtained, and based on these perpendicular lines and intersections, four ratios, $(B_1T_{b1}/B_1F_{15})$, $(T_{b1}F_7/B_1F_{15})$, $(B_1T_{b2}/B_1F_{15})$, and $(T_{b2}F_8/B_1F_{15})$, are obtained. These four ratios are used for the reproduction of the gathering end points mark line 2*d*; first, perpendicular lines $t_{d1}$, $t_{d2}$ and two intersections $T_{d1}$, $T_{d2}$ are reproduced, and finally, intermediate points $H_7$, $H_8$ are obtained. The gathering end points mark line 2*d* is then determined using the end points $D_1$, $H_{15}$ and intermediate points $H_7$, $H_8$.

Values relating to the recognition of the gathering end points mark line 2*b* and the reproduction of the gathering end points mark line 2*d* are shown in specific form in Table 6.

TABLE 6

Recognition of gathering end points mark line $2_d$ for back skirt

| Women Body Type | | Missy Body Type | |
|---|---|---|---|
| Length $B_1F_{15}$ | 159.7 | Length $D_1H_{15}$ | 158.1 |
| Length $B_1T_{b1}$ | 54.7 | Length $D_1T_{d1}$ | 54.2 |
| Ratio $(B_1T_{b1}/B_1F_{15})$ | 0.343 | Ratio $(D_1T_{d1}/D_1H_{15})$ | — |
| Distance $T_{b1}F_7$ | −12.1 | Distance $T_{d1}H_7$ | −12.0 |
| Ratio $(T_{b1}F_7/B_1F_{15})$ | −0.076 | Ratio $(T_{d1}H_7/D_1H_{15})$ | — |
| Length $B_1T_{b2}$ | 116.9 | Length $D_1T_{d2}$ | 115.7 |
| Ratio $(B_1T_{b2}/B_1F_{15})$ | 0.732 | Ratio $(D_1T_{d2}/D_1H_{15})$ | — |
| Distance $T_{b2}F_8$ | −9.5 | Distance $T_{d2}H_8$ | −9.3 |
| Ratio $(T_{b2}F_8/B_1F_{15})$ | −0.059 | Ratio $(T_{d2}H_8/D_1H_{15})$ | — |

Next, as shown in FIGS. 7(*a*) and 7(*b*) , manipulating lines for gathers and dart dividing, $E_aE_A$, $E_bE_B$, $E_cE_c$, $E_dE_D$, $E_eE_E$, $E_fE_F$, and manipulating lines, $F_aF_A$, $F_bF_B$, $F_cF_C$, $F_dF_D$, $F_eF_E$, $F_fF_F$, are each drawn using a straight line command. How these manipulating lines are drawn is determined according to the experience of the operator that uses the system of this embodiment. The end points of these manipulating lines are respectively recognized as points on curves $E_1E_2$, $E_6E_{11}$, $E_{10}E_{16}$, and curves $F_1F_2$ , $F_6F_{14}$, $F_{17}F_{16}$, and are reproduced on the object patterns, as shown in FIGS. 7(*c*) and 7(*d*), following a similar procedure to that described above. Manipulating lines, $G_aG_A$, $G_bG_B$, $G_cG_C$, $G_dG_D$, $G_eG_E$, $G_fG_F$, and manipulating lines, $H_aH_A$, $H_bH_B$, $H_cH_C$, $H_dH_D$, $H_eH_E$, $H_fH_F$, are drawn in the reproduction process.

Next, as shown in FIGS. 8(*a*) and 8(*b*), cut lines, $E_9E_{21}$, $E_{18}E_{19}$, $F_{18}F_{19}$, and $F_{20}F_{21}$, for loosening the fit around the hips, are each drawn using a perpendicular command. That is, the end points, $E_9$, $E_{18}$, $F_{18}$, and $F_{20}$ of these cut lines are recognized as on-the-line points (end points), and perpendicular lines are drawn from these end points $E_9$, $E_{18}$, $F_{18}$, and $F_{20}$ to respective straight lines $A_3E_4$ and $B_3F_4$. Similarly, such perpendicular commands are reproduced on the object patterns, as shown in FIGS. 8(*c*) and 8(*d*) .

Next, cutting is performed along the thus drawn cut lines $E_9E_{21}$, $E_{18}E_{19}$, $F_{18}F_{19}$, and $F_{20}F_{21}$. For the object patterns, cutting is performed along the cut lines $G_9G_{21}$, $G_{18}G_{19}$, $H_{18}H_{19}$, and $H_{20}H_{21}$.

As a result of the above cutting operation, the patterns for the front skirt and back skirt are each divided into three parts. That is, the front skirt shown in FIG. 9(*a*) is divided into part $E_1E_2E_{19}E_3$ (part $a_1$), part $E_6E_{11}E_{21}E_{19}$ (part $a_2$), and part $E_{10}E_{16}E_4E_{21}$ (part $a_3$). Similarly, the back skirt shown in FIG. 9(*b*) is divided into part $F_1F_2F_{21}F_3$ (part $b_1$), part $F_6F_{14}F_{19}F_{21}$ (part $b_2$), and part $F_{27}F_{16}F_4F_{19}$ (part $b_3$). Using a rotation command, the parts are then rotated about respective points $E_{19}$ and $E_{21}$ in such a manner as to create a 3 mm spacing between pick points $E_{23}$ and $E_{24}$ and also between pick points $E_{25}$ and $E_{26}$ to loosen the fit around the hips. In executing the rotation command for rotation about point $E_{19}$, the rotated parts $a_1$ and $a_2$, the center of rotation $E_{19}$, and the distance between pick points $E_{23}$ and $E_{24}$ after rotation are stored into memory. Similarly, for the rotation about point $E_{21}$, the rotated parts $a_2$ and $a_3$, the center of rotation $E_{21}$, and the distance between pick points $E_{25}$ and $E_{26}$ after rotation are stored into memory. Similar storing operations are performed for the back skirt. The amount of rotation performed by the rotation command may be given in terms of the angle of rotation instead of the distance between pick points.

Next, the above rotation command is reproduced on the object pattern for the front skirt shown in FIG. 9(*c*). As shown in FIG. 9(*c*), the front skirt is divided into part $G_1G_2G_{19}G_3$ (part $c_1$), part $G_6G_{11}G_{21}G_{19}$(part $c_2$), and part $G_{10}G_{16}G_4G_{21}$ (part $c_3$). Similarly, the back skirt shown in FIG. 9(*d*) is divided into part $H_1H_2H_{21}H_3$ (part $d_1$), part $H_6H_{14}H_{19}H_{21}$ (part $d_2$), and part $H_{27}H_{16}H_4H_{19}$ (part $d_3$). Using a rotation command, the parts are then rotated about respective points $G_{19}$ and $G_{21}$ in such a manner as to create a spacing between pick points $G_{23}$ and $G_{24}$ and also between pick points $G_{25}$ and $G_{26}$ to loosen the fit around the hips. In this case, the distance between pick points $G_{23}$ and $G_{24}$ and the distance between pick points $G_{25}$ and $G_{26}$ may be set at 3 mm as in the above example, but more appropriately, the spacing should be determined using a processing amount ratio r predetermined for the body part concerned and empirically obtained between Women Body Type, the reference pattern, and Missy Body Type, the object pattern. In the present embodiment, for the rotation command the distance between pick points $G_{23}$ and $G_{24}$ and the distance between pick points $G_{25}$ and $G_{26}$ are each set at 2 mm by using the processing amount ratio r=0.67 for the front skirt predetermined between Women body type, the reference pattern, and Missy Body Type, the object pattern. For the back skirt also, the rotation command is reproduced by using the processing amount ratio predetermined for the back skirt.

Figure 10:
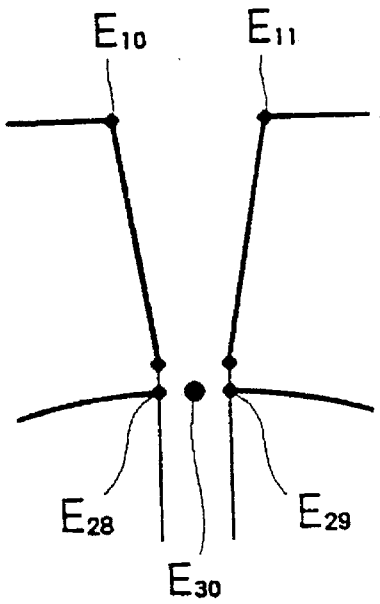
FIG. 10 is a diagram for explaining how a dart is redrawn after the cutting is performed on the pattern of FIG. 9(*a*).
Figure 11:
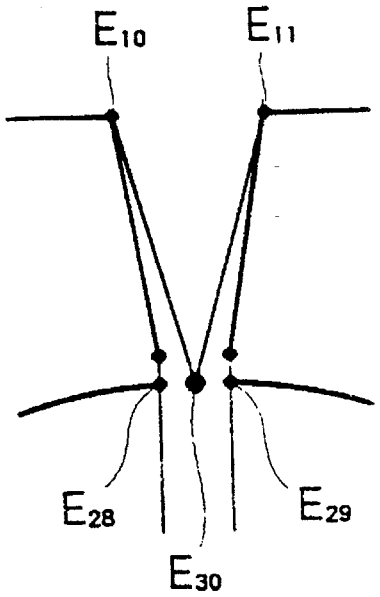
FIG. 11 is a diagram for explaining how a dart is redrawn after the cutting is performed on the pattern of FIG. 9(*a*).
Figure 12A:
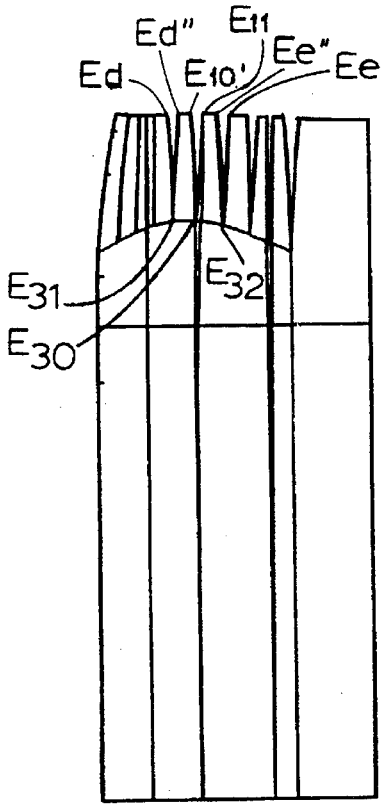
FIGS. 12(*a*) to 12(*d*) show how dart dividing is performed after the darts are redrawn as shown in FIGS. 10 and 11.
Figure 12B:
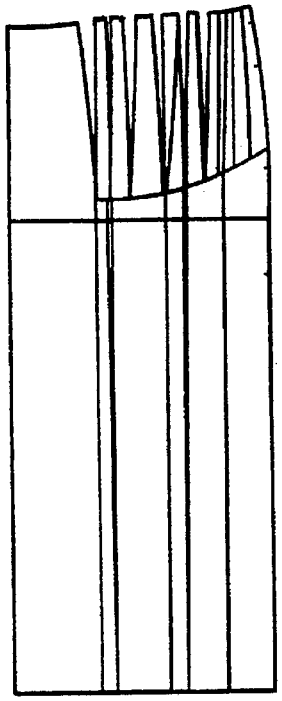
Figure 12C:
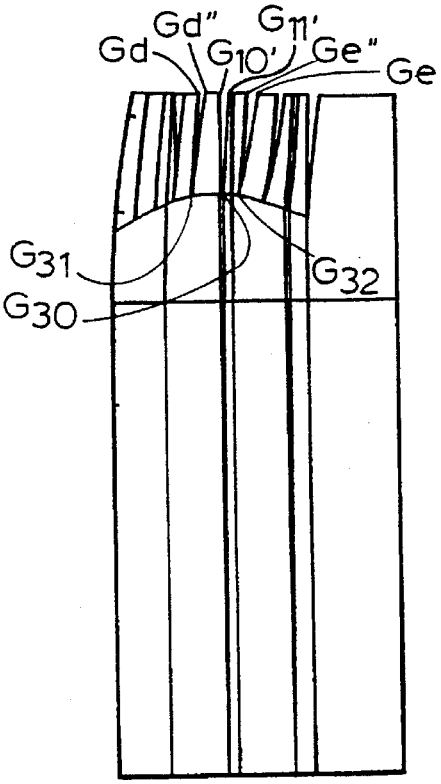
Figure 12D:
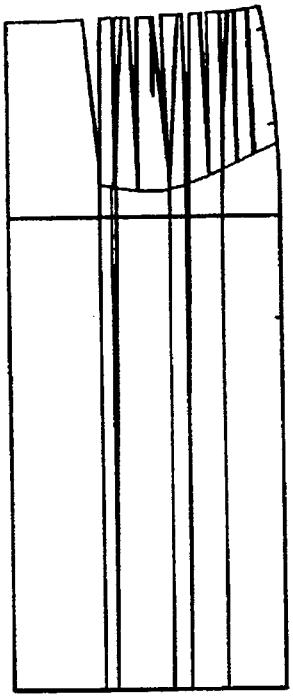

When the parts are cut and the rotation command is executed as described above, since the initially formed darts are cut off, the darts must be redrawn. FIGS. 10 and 11 are diagrams for explaining the redrawing of a dart $E_{10}E_{28}E_{29}E_{11}$ which is shown cut off in FIG. 9(*a*) . Using a marking command, a point $E_{30}$ is set at the midpoint between point $E_{28}$ and point $E_{29}$. The points $E_{28}$ and $E_{29}$ are respectively recognized as on-the-line points, while the midpoint $E_{30}$ is recognized as an independent point. Then, points $E_{10}$ and $E_{30}$ and points $E_{11}$ and $E_{30}$ are respectively connected by using respective straight lines, thus forming a new dart. Such dart formation is performed on the other dart shown in FIG. 9(*a*) . The two darts in the back skirt shown in FIG. 9(*b*) are also processed in a similar way. Then, the formation of new darts is reproduced in the same manner as described above, to form new darts in the object patterns shown in FIGS. 9(*c*) and 9(*d*) .

Figure 13A:
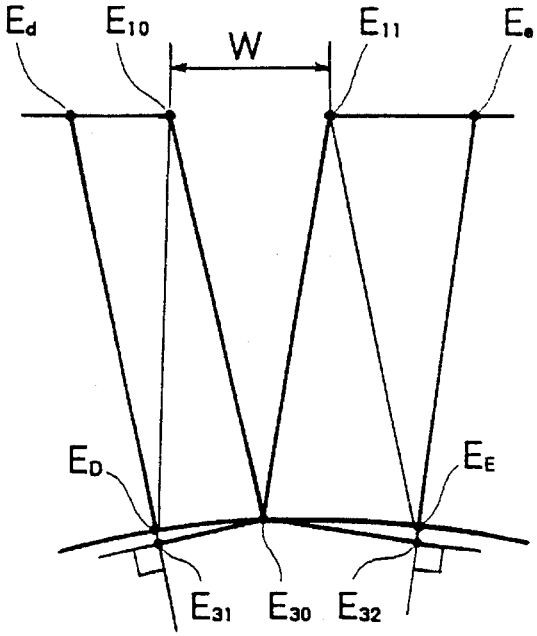
FIGS. 13(*a*) to 13(*c*) show is a series of diagrams for explaining the dart dividing procedure.
Figure 13B:
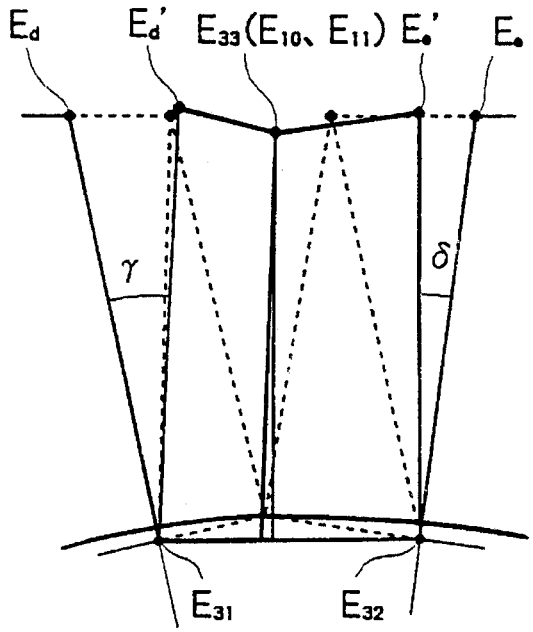
Figure 13C:
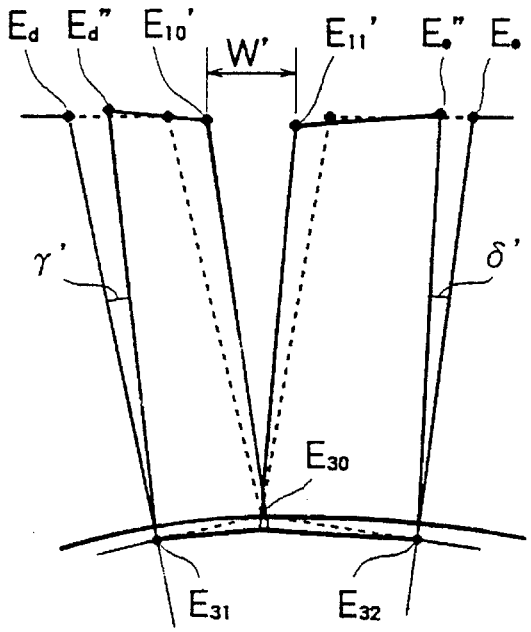
Figure 14A:
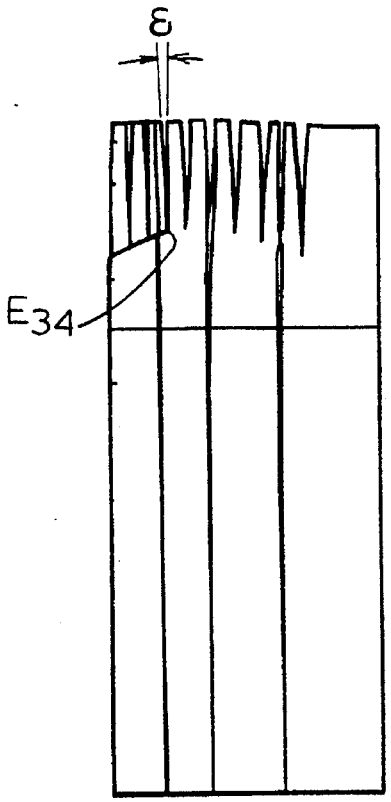
FIGS. 14(*a*) to 14(*d*) show how gathers are formed in the patterns of FIGS. 12(*a*) to 12(*d*).
Figure 14B:
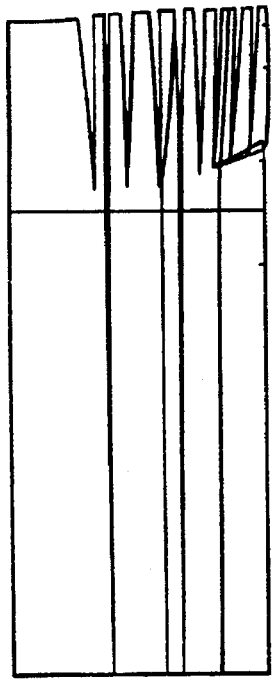
Figure 14C:
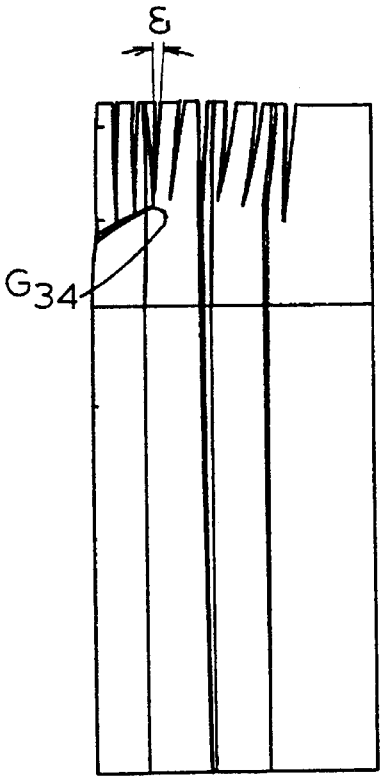
Figure 14D:
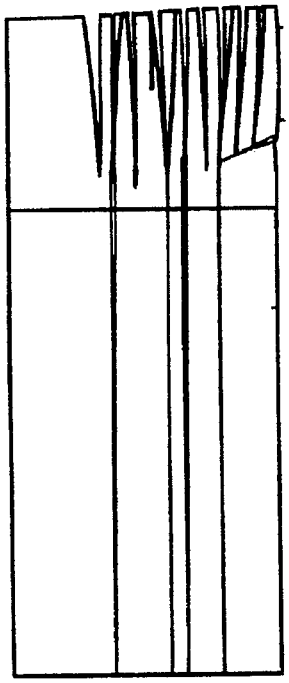
Figure 15A:
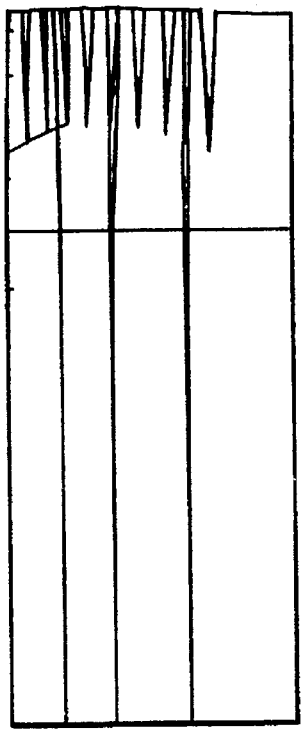
FIGS. 15(*a*) to 15(*d*) show how a waist line is redrawn on the patterns of FIGS. 14 (*a*) to 14 (*d*) .
Figure 15B:
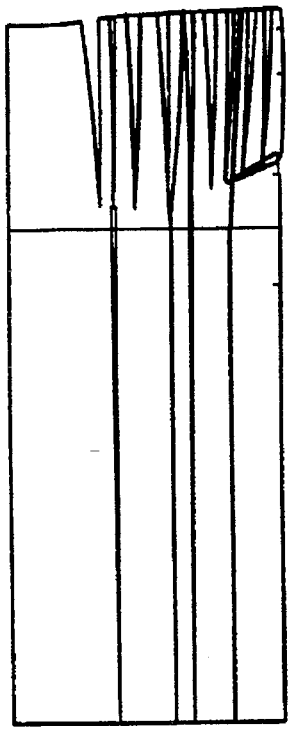
Figure 15C:
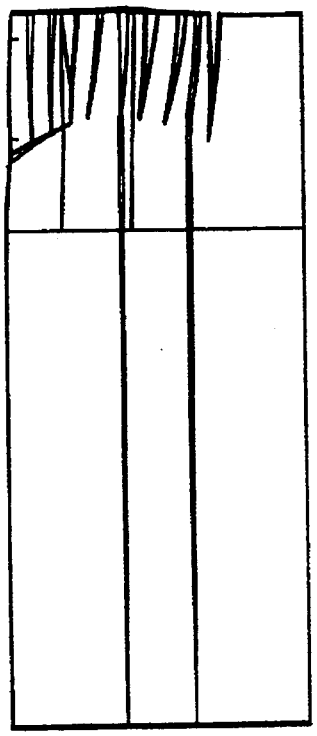
Figure 15D:
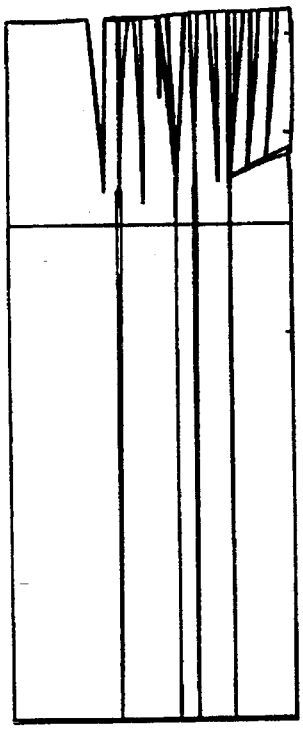
Figure 16A:
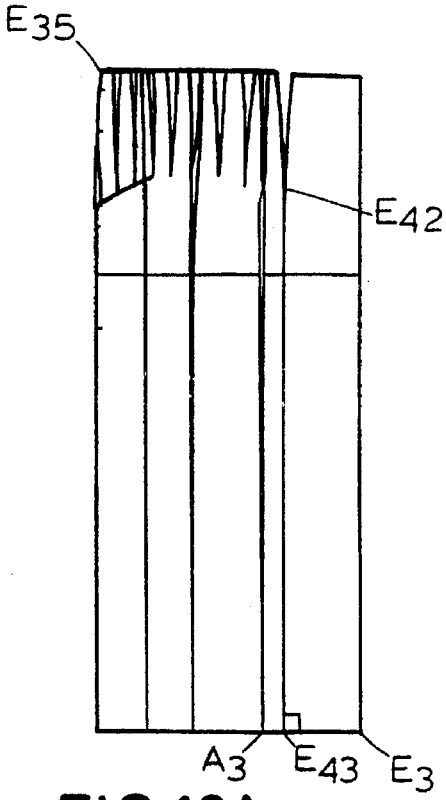
FIGS. 16(*a*) to 16(*d*) show how a side line is redrawn on the patterns of FIGS. 15(*a*) to 15(*d*).
Figure 16B:
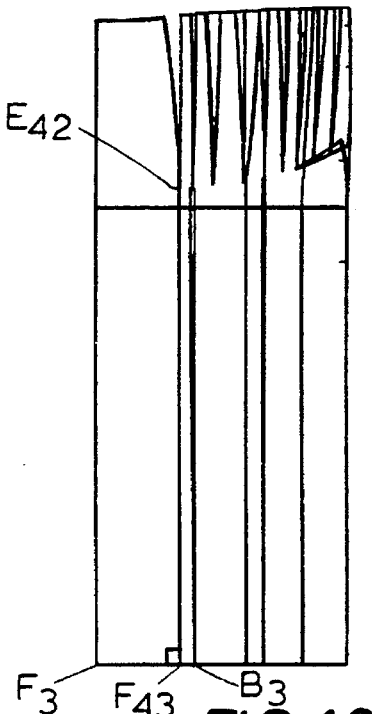
Figure 16C:
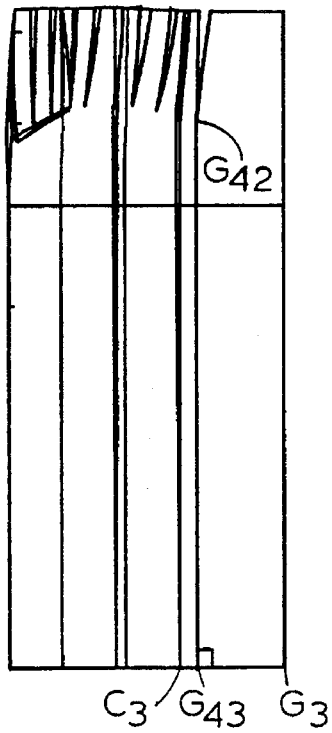
Figure 16D:
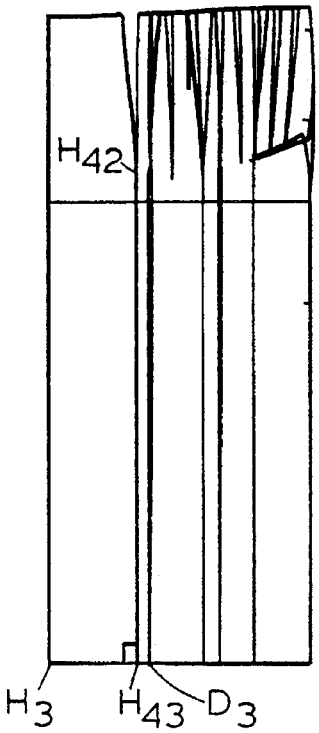

Next, using a dart dividing command, dart dividing is performed as shown in FIGS. 12(*a*) and 12(*b*) . FIGS. 13(*a*), 13(*b*), and 13(*c*) are diagrams for explaining the dividing of the darts described with reference to FIGS. 10 and 11. On both sides of the dart $E_{10}E_{30}E_{11}$ are already drawn the manipulating lines for dart dividing, $E_dE_D$ and $E_eE_E$, as previously explained with reference to FIG. 7. Perpendiculars are dropped from point $E_{30}$ to the extended lines of the manipulating lines $E_dE_D$ and $E_eE_E$ respectively. Then, the intersections are denoted by $E_{31}$ and $E_{32}$, respectively. Arcs are drawn about the points $E_{31}$ and $E_{32}$, with line segments $E_{31}E_{10}$ and $E_{32}E_{11}$ as the respective radii, and the intersection $E_{33}$ between the arcs is obtained as shown in FIG. 13(*b*) . Further, the parts $E_dE_{31}E_{30}E_{10}$ and $E_eE_{32}E_{30}E_{11}$ are rotated about the respective points $E_{31}$ and $E_{32}$ in such a manner that the points $E_{10}$ and $E_{11}$ coincide with the point $E_{33}$. The result is the formation of two angles, $\gamma_0(<E_dE_{31}E_d')$ and $\delta_0(<E_eE_{32}E_e')$. The parts $E_dE_{31}E_{30}E_{10}$ and $E_eE_{32}E_{30}E_{11}$ are rotated about the respective points $E_{31}$ and $E_{32}$ with the angular ratio $\delta(<E_dE_{31}E_d'')/\gamma(<E_eE_{32}E_e'')$ maintained to equalize to $\gamma_0/\delta_0$, and determined at prescribed positions, thereby forming three new darts $E_dE_{31}E_d''$, $E_eE_{32}E_3''$, and $E_{10}'E_{30}E_{11}'$, as shown in FIG. 13(*c*) . In the present embodiment, the points $E_{10}$ and $E_{11}$ correspond to dart end points, the point $E_{30}$ corresponds to dart base point, the points $E_d$ and $E_e$ correspond to manipulating base point, and the points $E_{31}$ and $E_{32}$ correspond to the intersections about which the respective cut parts are rotated.

Figure 1:
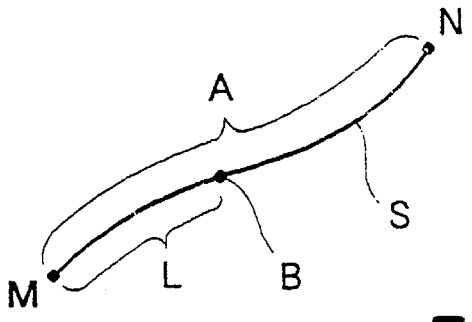
FIG. 1 is a diagram for explaining the function of an on-the-line point recognizing means.
Figure 2:
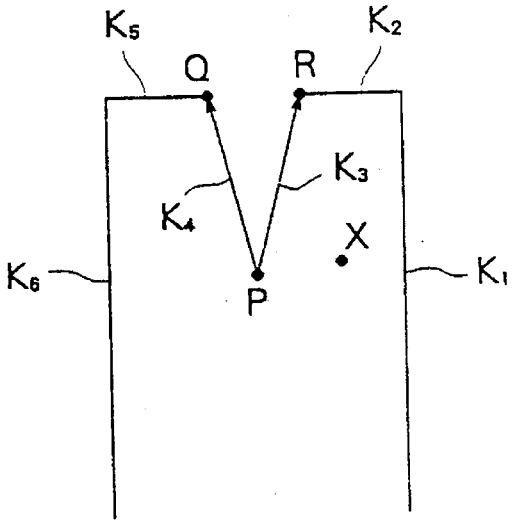
FIG. 2 is a diagram for explaining the function of a free point recognizing means.
Figure 3:
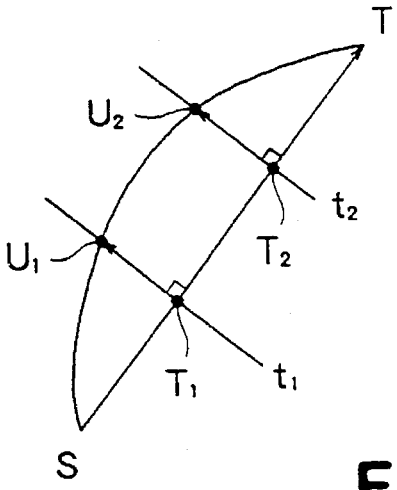
FIG. 3 is a diagram for explaining the function of a curve recognizing means.
Figure 4A:
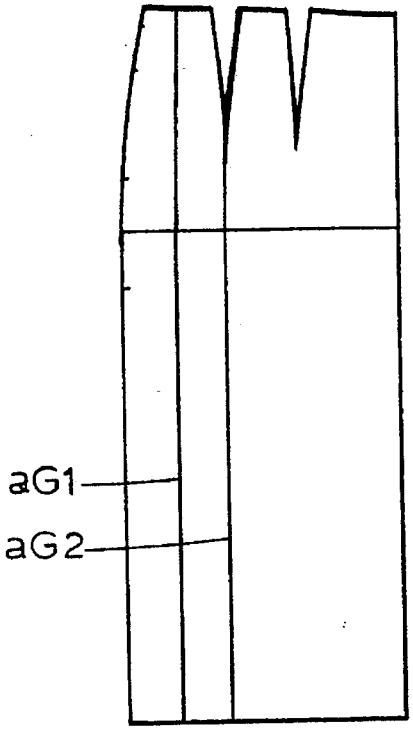
FIGS. 4(*a*) and 4(*b*) are diagrams for showing patterns (reference patterns) for a front skirt and a back skirt, respectively, for Women Body Type before pattern making and pattern drafting processing.
Figure 4B:
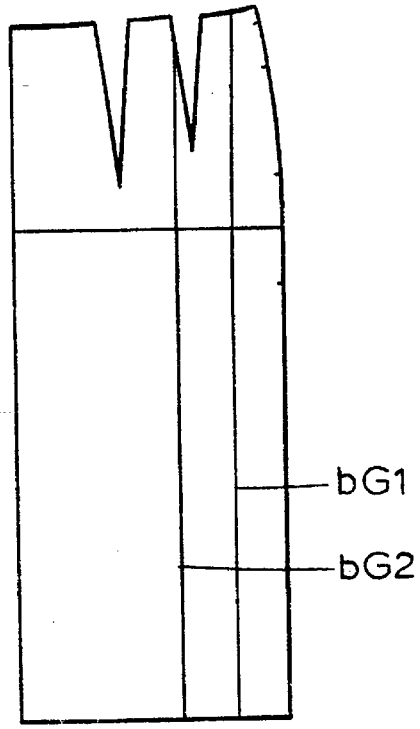
Figure 4C:
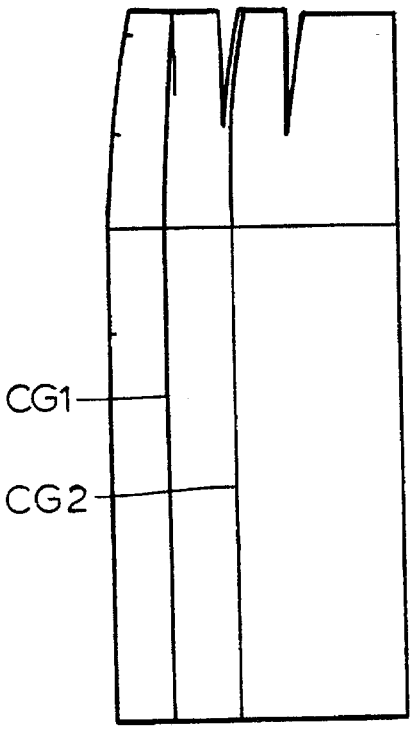
Figure 4D:
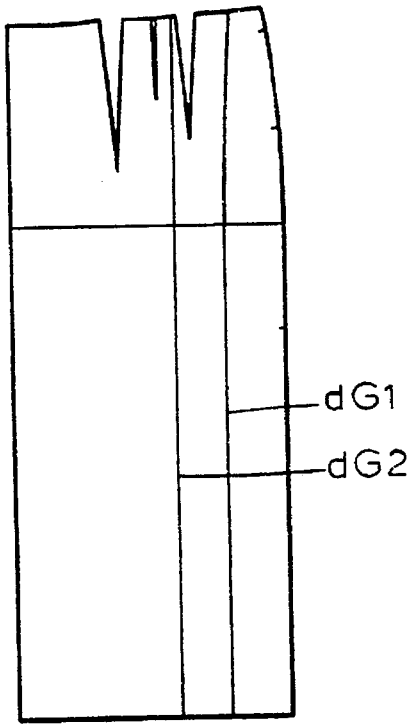
Figure 5A:
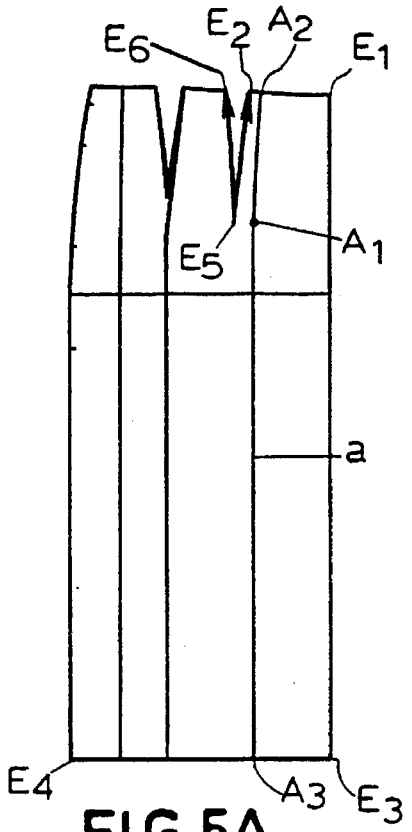
FIGS. 5(*a*) to 5(*d*) show how a panel line is drawn on the patterns of FIGS. 4(*a*) to 4(*d*).
Figure 5B:
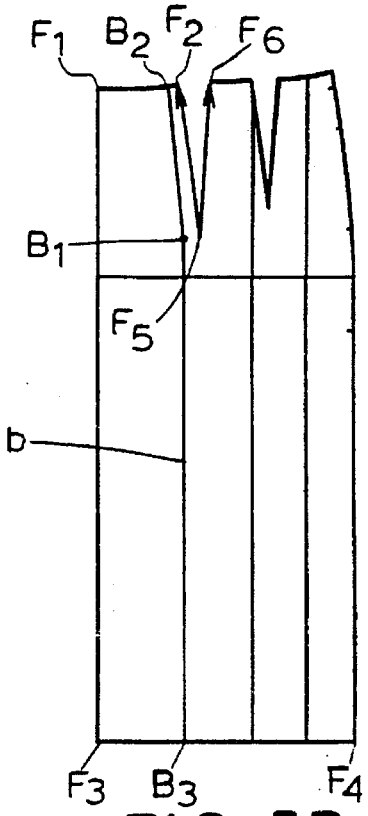
Figure 5C:
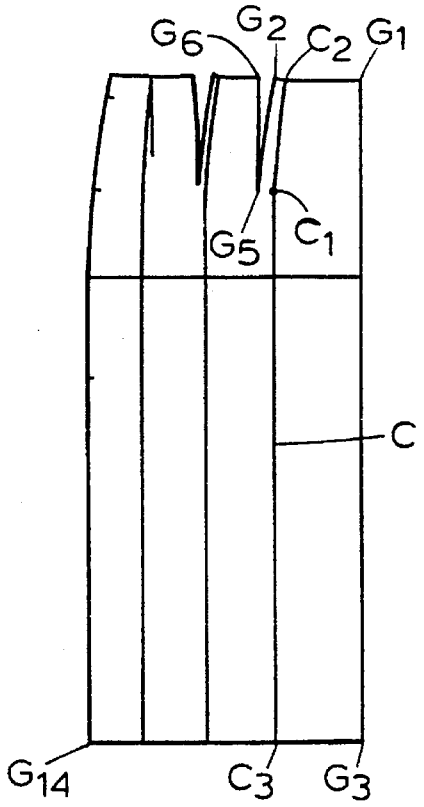
Figure 5D:
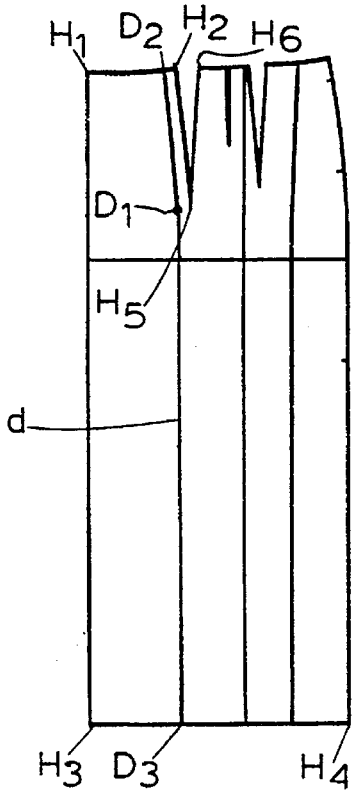
Figure 6A:
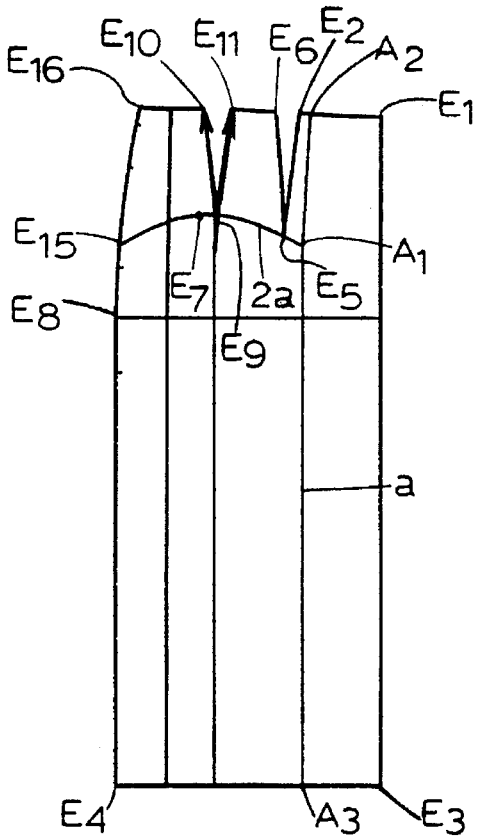
FIGS. 6(*a*) to 6(*d*) show how a line at which to stop the gathering (a gathering end points mark line) is drawn on the patterns of FIGS. 5(*a*) to 5(*d*) .
Figure 6B:
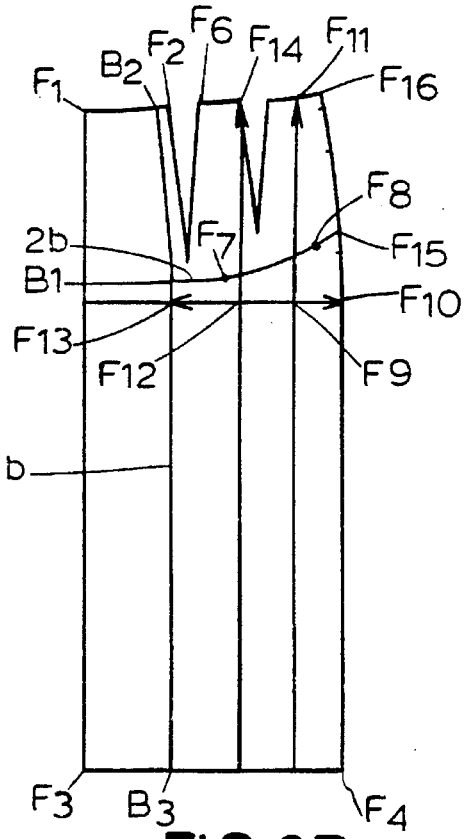
Figure 6C:
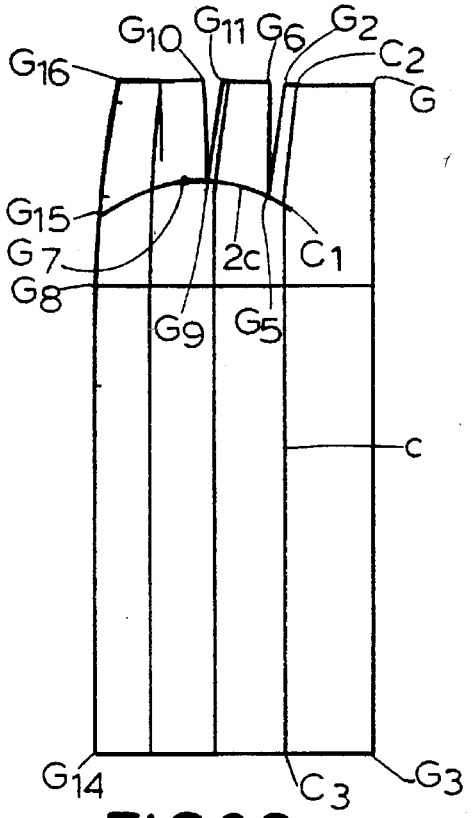
Figure 6D:
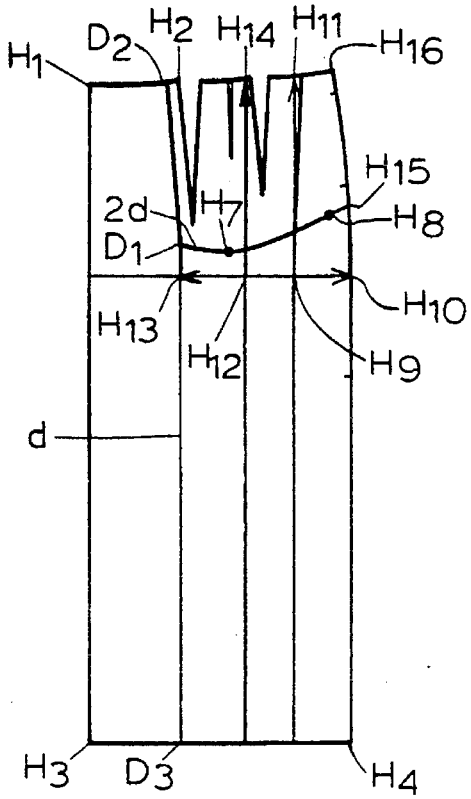
Figure 7A:
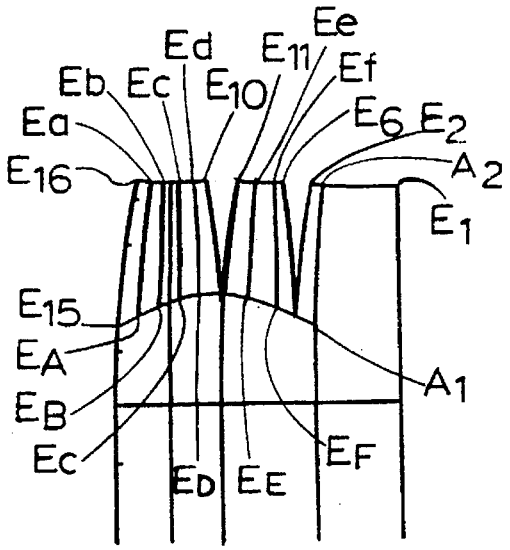
FIGS. 7(*a*) to 7(*d*) show how manipulating lines for gathers and dart dividing are drawn on the patterns of FIGS. 6(*a*) to 6(*d*) .
Figure 7B:
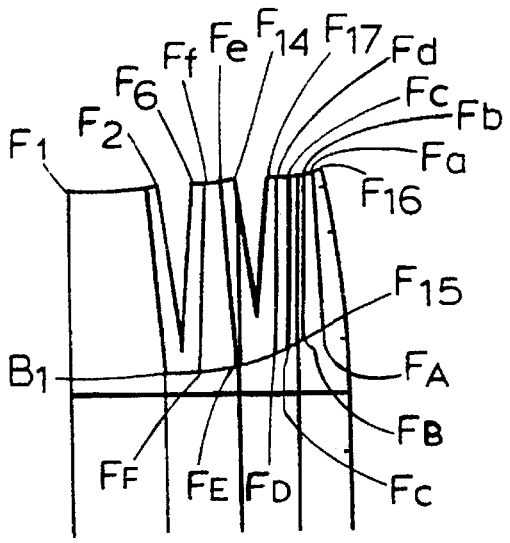
Figure 7C:
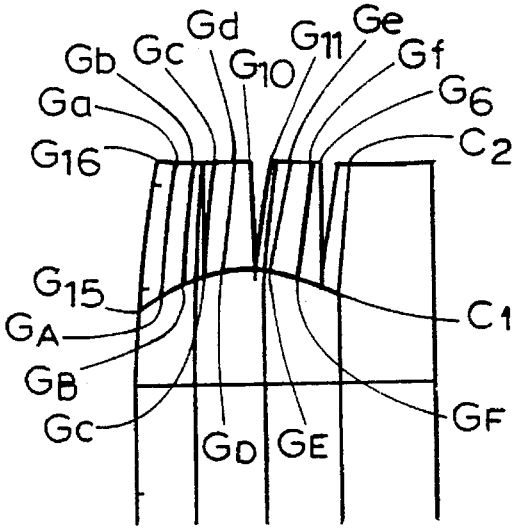
Figure 7D:
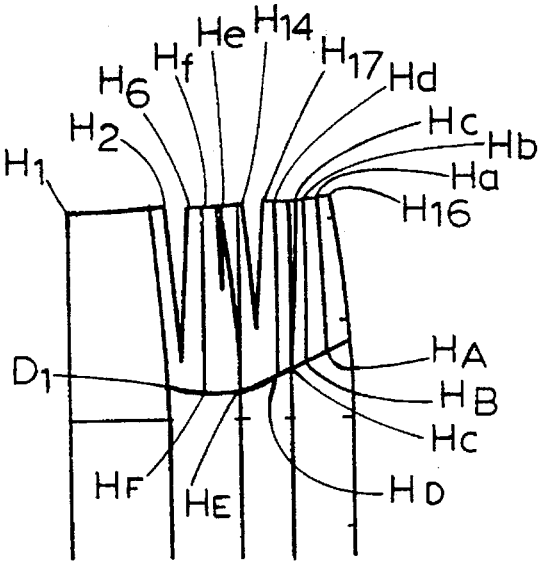
Figure 8A:
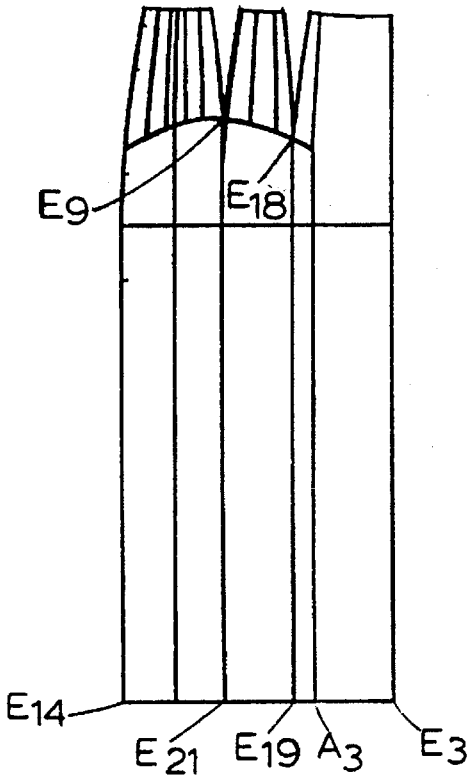
FIGS. 8(*a*) to 8(*d*) show how cut lines for loosening the fit around the hips are drawn on the patterns of FIGS. 7(*a*) to 7(*d*).
Figure 8B:
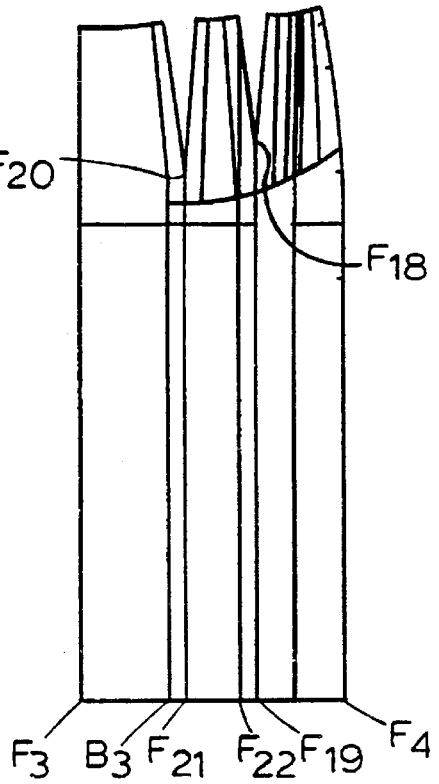
Figure 8C:
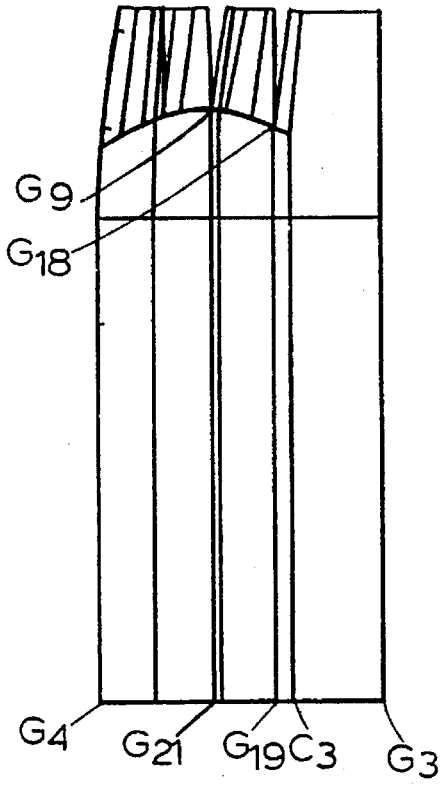
Figure 8D:
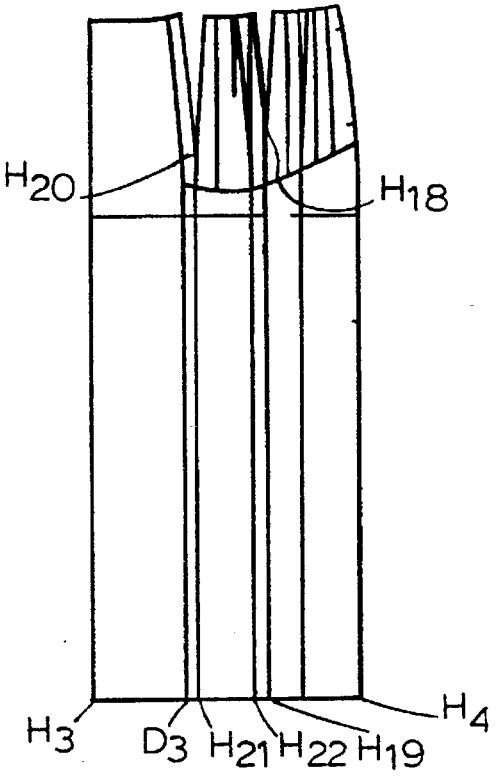
Figure 9A:
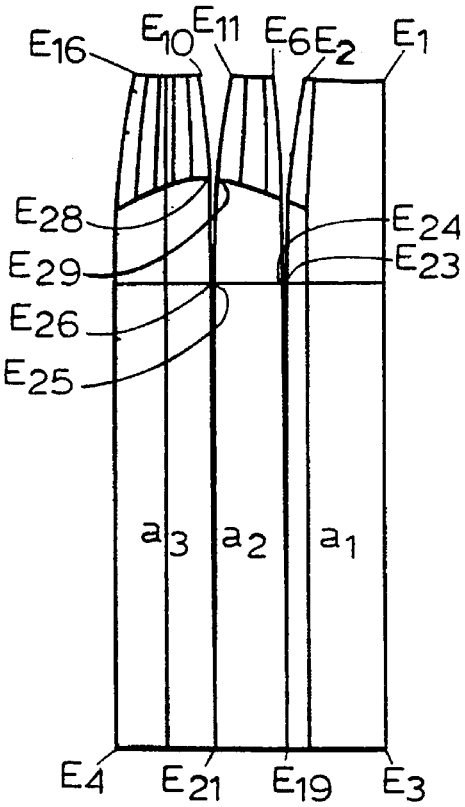
FIGS. 9(*a*) to 9(*d*) show how cutting is performed along the cut lines shown in FIGS. 8(*a*) to 8(*d*) to loosen the fit around the hips.
Figure 9B:
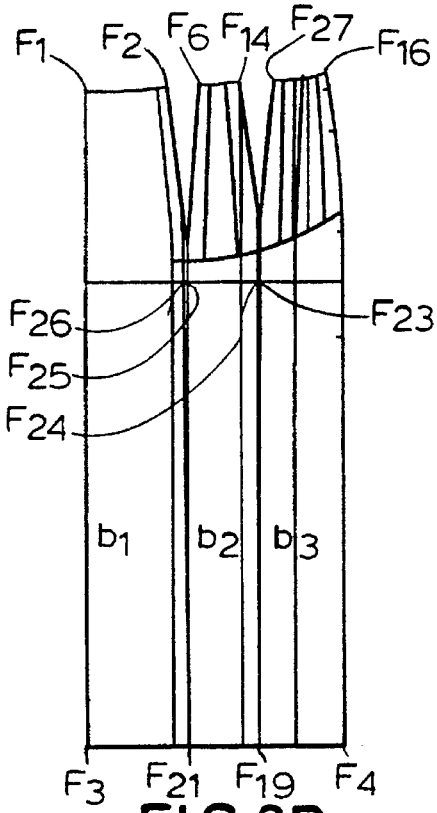
Figure 9C:
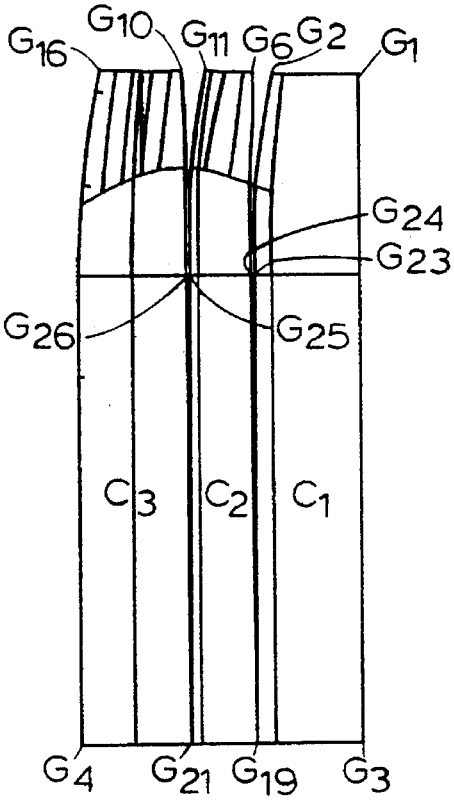
Figure 9D:
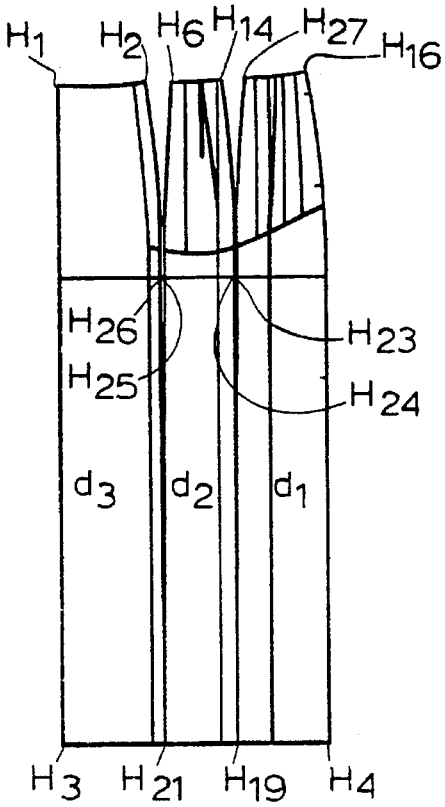

The amount of processing in such dart dividing is recognized as a ratio W'/W, where W is the distance between the points $E_{10}$ and $E_{11}$ before dart dividing, as shown in FIG. 3(*a*), and W' is the distance between the points $E_{10}'$ and $E_{11}'$ after dart dividing, as shown in FIG. 13(*c*). Therefore, when performing dart dividing on the object patterns shown in FIGS. 12(*c*) and 12(*d*), the distance $G_{10}G_{11}$ (FIG. 9(*c*)) multiplied by the ratio W'/W is used as the distance $G_{10}'G_{11}'$ (FIG. 12(*c*)). In the present embodiment, the dart distance ratios W'/W in the reference patterns shown in FIGS. 12(*a*) and 12(*b*) are directly used when reproducing the dart dividing command performed on the corresponding object patterns shown in FIGS. 12(*c*) and 12(*d*). Alternatively, the processing amount ratio for the dart dividing command may be predetermined between Women Body Type and Missy Body Type, as in the previously described example, and the dart distance to be applied to the object pattern may be determined by multiplying the ratio W'/W by the predetermined processing amount ratio.

Such dart dividing is performed on the other dart shown in FIG. 12(*a*). The two darts in the back skirt shown in FIG. 12(*b*) are also processed in a similar manner. Then, the formation of darts is reproduced on the object patterns shown in FIGS. 12(*c*) and 12(*d*) by using the same ratio as described above, thus completing the operation of dart dividing. Reference numerals in FIGS. 12(*b*) and 12(*d*) are omitted.

Next, gathers are put in the side part of each pattern as shown in FIGS. 14(*a*) and 14(*b*). These gathers are formed by using a successive manipulating command. In the present embodiment, the amount of processing performed by the successive manipulating command is recognized in terms of an angle $\epsilon$ of each gather. For example, in forming the gather shown in FIG. 14(*a*) with point $E_{34}$ (on-the-line point) as its vertex, the processing amount is recognized in terms of the opening angle $\epsilon$ of the gather. For the object pattern shown in FIG. 14(*c*), the successive manipulating command is reproduced using point $G_{34}$ corresponding to the point $E_{34}$ and the opening angle $\epsilon$. Similarly, for the gathers in the back skirt shown in FIG. 14(*b*) as well as the other gathers shown in FIG. 14(*a*), the opening angle is recognized as the amount of processing, and the successive manipulating command is reproduced on the object patterns shown in FIGS. 14(*c*) and 14(*d*) in the same manner as above. In the present embodiment, the opening angle $\epsilon$ of each gather in the reference patterns shown in FIGS. 14(*a*) and 14(*b*) is directly used when reproducing the successive manipulating command on the object patterns shown in FIGS. 14(*c*) and 14(*d*). Alternatively, the processing amount ratio between Women Body Type and Missy Body Type may be predetermined, as previously described, and the opening angle of each gather in the object patterns may be determined by multiplying the opening angle $\epsilon$ in the reference pattern by the predetermined processing amount ratio.

Figure 17:
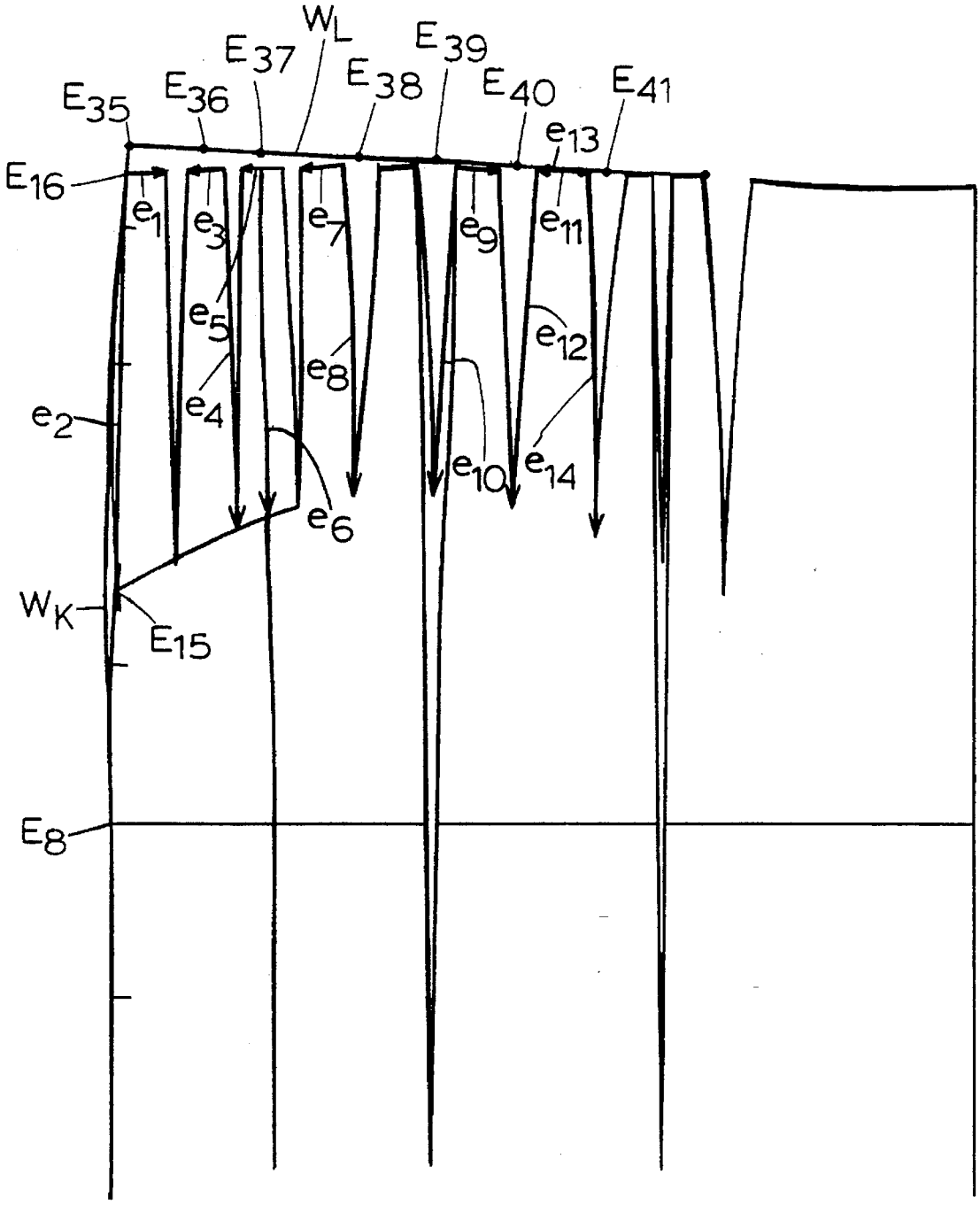
FIG. 17 is a diagram for explaining the procedure for redrawing a waist line and a side line on the pattern of FIG. 14(*a*) .
Figure 18A:
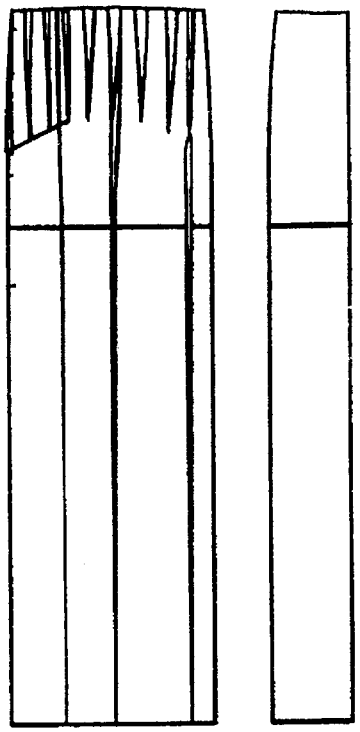
FIGS. 18(*a*) and 18(*b*) are diagrams for showing finished patterns for the front skirt and back skirt, respectively, for Women Body Type, and FIGS. 18(*c*) and 18(*d*) show finished patterns for the front skirt and back skirt, respectively, for Missy Body Type.
Figure 18B:
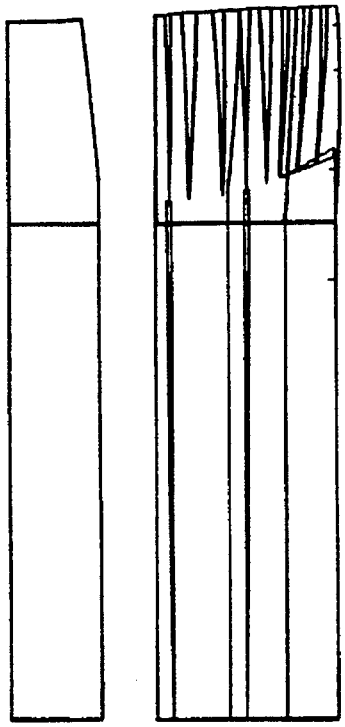
Figure 18C:
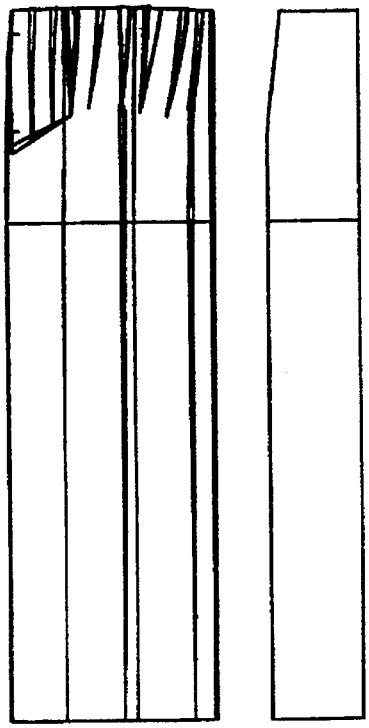
Figure 18D:
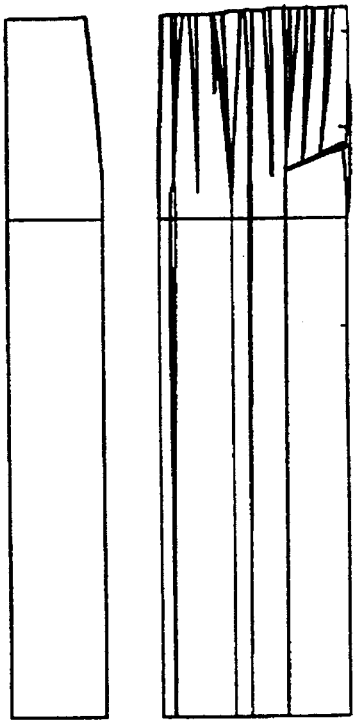

When the dart dividing and successive manipulating are performed as described above, the dart and gather spacings become wider. To correct for this, the waist line needs to be redrawn. FIG. 15 shows a redrawn waist line, the procedure for which is shown in FIG. 17. FIG. 17 is an enlarged view of the waist part of the front skirt shown in FIG. 15(*a*). As shown, a new waist line $W_L$ is drawn by using a curve command. The waist line $W_L$ is defined by points $E_{35}$–$E_{41}$ on that line. These points $E_{35}$–$E_{41}$ are recognized as free points. More specifically, as shown in FIG. 17, the point $E_{35}$ is recognized by a vector $e_2$ directed from its nearest point $E_{16}$ to point $E_{15}$, a vector $e_1$, and the aforementioned coefficients $\alpha$ and $\beta$ defined by these vectors. Similarly, the point $E_{36}$ is defined by using vectors $e_3$ and $e_4$, and further, the points $E_{37}$, $E_{38}$, $E_{39}$, $E_{40}$, and $E_{41}$ are recognized in a similar manner by using corresponding vectors $e_5$ to $e_{14}$ originating from the respective nearest points. The points $E_{35}$–$E_{41}$ thus recognized on the reference pattern in FIG. 15(*a*) are reproduced on the object pattern in FIG. 15(*c*) to form the waist line.

When successive manipulating is performed to form gathers as described above, a discontinuity is created in the side line on the front skirt and back skirt. To eliminate this discontinuity, a side line $W_K$ is redrawn using a curve command, as shown in FIG. 17. This side line $W_K$ is a curve leading from point $E_{35}$ to point $E_8$, but not passing through the point $E_{15}$. Detailed description of how the side line $W_K$ is recognized will not be given here; it suffices to say that the side line $W_K$ is drawn by using a curve command similar to the one described above, designating three free points in addition to the end points $E_{35}$ and $E_8$. The side line is redrawn on the back skirt as well as on the front skirt shown in FIG. 17. FIGS. 16(*a*) to 16(*d*) show the reference patterns and object patterns each with a redrawn side line $W_K$.

Next, cut lines are drawn for cutting along the seam lines 1 shown in FIG. 19.

The cut lines are each drawn using a perpendicular command. In FIG. 16(*a*), the cut line is drawn by dropping a perpendicular $E_{42}E_{43}$ to a straight line $A_3E_3$ from point $E_{42}$. In the object pattern shown in FIG. 16(*c*), the cut line is drawn by dropping a perpendicular $C_{42}G_{43}$ to a straight line $C_3G_3$ from point $G_{42}$. Similarly, for the back skirts shown in FIGS. 16(*b*) and 16(*d*), the cut lines are formed by drawing perpendiculars $F_{42}F_{43}$ and $H_{42}H_{43}$, respectively.

Finally, cutting is performed along the thus drawn cut lines corresponding to the seam lines 1 shown in FIG. 19. FIGS. 18(*a*) to 18(*d*) show the respective patterns after cutting.

In the procedure as described above, the pattern making and pattern drafting processing steps performed on the reference patterns for the front skirt and back skirt designed for Women Body Type are reproduced on the object patterns for the front skirt and back skirt for Missy Body Type.

The present embodiment has been described dealing with a case in which the system of the present invention is applied to the pattern making and pattern drafting for a skirt, but it will be appreciated that the invention is not limited to the illustrated example and can be applied to other garments. Furthermore, in the description of the present embodiment, the pattern making and pattern drafting process for Women Body Type is reproduced for the making of patterns for Missy Body Type, but it will be recognized that the pattern making and pattern drafting process can be reproduced for other body types as well and can also be applied to various sizes of other body types.

What is claimed is:

1. A pattern making and pattern drafting system comprising:

(A) pattern storing means for storing a pattern group including a plurality of base patterns each having a prescribed base line and base point;

(B) command executing means for executing commands to perform prescribed processing on said patterns;

(C) executed-command storing means for sequentially storing the commands performed by an operator on a reference pattern selected from said pattern group; and (D) command reproducing means for sequentially reproducing the commands stored in said executed-command storing means, thereby performing the processing, in the same order as followed by said command executing means, on at least one object pattern to be processed, other than said reference pattern, selected from said pattern group.

2. A pattern making and pattern drafting system according to claim 1, wherein said executed-command storing means stores executed-command information including information selected from the type of command executed by said command executing means, a target line for processing, a target point for processing, and the amount of processing performed, said target point and said amount of processing being recognized by reference to existing lines consisting of said base line and other lines drawn on said reference pattern and also to existing points consisting of said base point, both end points of each of said existing lines, and other points drawn on said reference pattern.

3. A pattern making-and pattern drafting system according to claim 2, wherein said executed-command storing means further includes on-the-line point recognizing means for recognizing said target point lying on any one of said existing lines as an on-the-line point, and said on-the-line point recognizing means recognizes said on-the-line point by reference to: said existing line on which said point lies; a ratio L/A where A is the overall length from one end to the other end of said existing line and L is the length measured from said one end to said point on line; and said one end of said existing line.

4. A pattern making and pattern drafting system according to claims 2 or 3, wherein said executed-command storing means further includes free point recognizing means for recognizing said target point not lying on any of said existing lines as a free point, and said free point recognizing means obtains coefficients $\alpha$ and $\beta$ from the equation, $$\text{Position of free point}=\alpha x\ (\text{vector } PQ)+\beta x\ (\text{vector } PR),$$

where P is a nearest existing point selected from among said existing points as being the nearest to said free point and PQ and PR are vectors leading from said nearest existing point P to two existing points Q and R adjacent thereto, and recognizes said free point by said vectors PQ and PR and said coefficients $\alpha$ and $\beta$.

5. A pattern making and pattern drafting system according to claims 2 or 3, wherein said executed-command storing means further includes a curve recognizing means for recognizing the shape and position of a curve defined by a start point, an end point, and at least one intermediate point, and said curve recognizing means recognizes the shape and position of a curve by reference to: said start point and said end point; the ratio, to the length of a reference straight line connecting said start point and said end point, of the distance from said intermediate point to an intersection where a straight line passing through said intermediate point intersects at right angles with said reference straight line;

and the ratio of the distance from said start point to said intersection, to the length of said reference straight line.

6. A pattern making and pattern drafting system according to claims 2 or 3, further comprising processing amount ratio storing means for storing the ratio between the amount of processing included in said executed-command information for said reference pattern and the amount of processing included in said executed-command information for said object pattern, for a command which obtains said amount of processing from said executed-command information, wherein when reproducing a command, executed on said reference pattern and stored in said executed-command storing means, on said object pattern, said command reproducing means obtains the amount of processing to be performed by said command on said object pattern by reference to said ratio stored in said processing amount ratio storing means.

7. A pattern making and pattern drafting system according to claims 1, 2 or 3, further comprising dart dividing means for dividing a dart into multiple darts, tapering off to a dart base point inside a pattern from two dart end points lying on an existing line forming a periphery of said pattern, by using two manipulating lines extending substantially parallel to said dart from manipulating base points respectively lying outward of said dart end points on the base line forming said periphery, wherein said dart dividing means obtains points of intersection between each of said manipulating lines or extended lines thereof and perpendiculars dropped to each of said manipulating lines or said extended lines, respectively, obtains two cut parts by cutting along said lines respectively extending from said points of intersection to said manipulating base points and along lines respectively extending from said points of intersection to said dart base point, finds an angle of rotation, $\gamma_0$, of one cut part and an angle of rotation, $\delta_0$, of the other cut part when said cut parts are rotated, describing arcs with line segments connecting said points of intersection to said dart end points as respective radii, in such a manner as to bring said dart end points into overlapping together at an intersection of said arcs, and rotates said cut parts about said respective points of intersection toward the intersection between said arcs to determine the positions of said cut parts at prescribed positions where the ratio of an angle of rotation, $\gamma$, of said one cut part to an angle of rotation, $\delta$, of said other cut part, i.e., the ratio $\gamma/\delta$ becomes equal to the ratio $\gamma_0/\delta_0$.

8. A pattern making and pattern drafting system according to claim 7, wherein said executed-command storing means performs recognition in terms of a ratio W'/W, i.e., the ratio of the distance W' between said dart end points after dart dividing to the distance W between said dart end points before dart dividing.

9. A pattern making and pattern drafting system according to claim 8, wherein said pattern group consists of patterns in a plurality of sizes for one body type.

10. A pattern making and pattern drafting system according to claim 8, wherein said pattern group consists of patterns in a plurality of sizes for each of a plurality of body types.

11. A pattern making and pattern drafting system according to claim 4, wherein said executed-command storing means further includes a curve recognizing means for recognizing the shape and position of a curve defined by a start point, an end point, and at least one intermediate point, and said curve recognizing means recognizes the shape and position of a curve by reference to: said start point and said end point; the ratio, to the length of a reference straight line connecting said start point and said end point, of the distance from said intermediate point to an intersection where a straight line passing through said intermediate point intersects at right angles with said reference straight line;

and the ratio of the distance from said start point to said intersection, to the length of said reference straight line.

12. A pattern making and pattern drafting system according to claim 11, further comprising processing amount ratio storing means for storing the ratio between the amount of processing included in said executed-command information for said reference pattern and the amount of processing included in said executed-command information for said object pattern, for a command which obtains said amount of processing from said executed-command information, wherein when reproducing a command, executed on said reference pattern and stored in said executed-command storing means, on said object pattern, said command reproducing means obtains the amount of processing to be performed by said command on said object pattern by reference to said ratio stored in said processing amount ratio storing means.

13. A pattern making and pattern drafting system according to claim 12, further comprising dart dividing means for dividing a dart into multiple darts, tapering off to a dart base point inside a pattern from two dart end points lying on an existing line forming a periphery of said pattern, by using two manipulating lines extending substantially parallel to said dart from manipulating base points respectively lying outward of said dart end points on the base line forming said periphery, wherein said dart dividing means obtains points of intersection between each of said manipulating lines or extended lines thereof and perpendiculars dropped to each of said manipulating lines or said extended lines, respectively, obtains two cut parts by cutting along said lines respectively extending from said points of intersection to said manipulating base points and along lines respectively extending from said points of intersection to said dart base point, finds an angle of rotation, $\gamma_0$, of one cut part and an angle of rotation, $\delta_0$, of the other cut part when said cut parts are rotated, describing arcs with line segments connecting said points of intersection to said dart end points as respective radii, in such a manner as to bring said dart end points into overlapping together at an intersection of said arcs, and rotates said cut parts about said respective points of intersection toward the intersection between said arcs to determine the positions of said cut parts at prescribed positions where the ratio of an angle of rotation, $\gamma$, of said one cut part to an angle of rotation, $\delta$, of said other cut part, i.e., the ratio $\gamma/\delta$ becomes equal to the ratio $\gamma_0/\delta_0$.

14. A pattern making and pattern drafting system according to claim 13, wherein said executed-command storing means performs recognition in terms of a ratio W'/W, i.e., the ratio of the distance W' between said dart end points after dart dividing to the distance W between said dart end points before dart dividing.

15. A pattern making and pattern drafting system according to claim 14, wherein said pattern group consists of patterns in a plurality of sizes for one body type.

16. A pattern making and pattern drafting system according to claim 15, wherein said pattern group consists of patterns in a plurality of sizes for each of a plurality of body types.

17. A pattern making and pattern drafting method comprising:

(A) storing a pattern group including a plurality of base patterns each having a prescribed base line and base point;

(B) executing commands to perform prescribed processing on said patterns;

(C) sequentially storing the commands performed by an operator on a reference pattern selected from said pattern group; and (D) sequentially reproducing the stored commands and thereby performing the processing, in the same order as in step (B), on at least one object pattern to be processed, other than said reference pattern, selected from said pattern group.

* * * * *